US007081912B2

(12) United States Patent
Seki et al.

(10) Patent No.: US 7,081,912 B2
(45) Date of Patent: Jul. 25, 2006

(54) OPTICAL WRITING HEAD SUCH AS ORGANIC EL ARRAY EXPOSURE HEAD, METHOD OF MANUFACTURING THE SAME, AND IMAGE FORMING APPARATUS USING THE SAME

(75) Inventors: Hideya Seki, Nagano-Ken (JP); Masatoshi Yonekubo, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 212 days.

(21) Appl. No.: 10/383,865

(22) Filed: Mar. 10, 2003

(65) Prior Publication Data

US 2004/0021762 A1 Feb. 5, 2004

(30) Foreign Application Priority Data

Mar. 11, 2002 (JP) ..... 2002-065045
Apr. 1, 2002 (JP) ..... 2002-098458

(51) Int. Cl.
*B41J 27/00* (2006.01)

(52) U.S. Cl. ..... 347/244; 347/258

(58) Field of Classification Search ..... 347/237, 347/241–245, 247, 256–258, 130, 238, 134, 347/137; 399/186, 379; 313/506, 509; 257/88; 362/555, 612, 613
See application file for complete search history.

(56) References Cited

U.S. PATENT DOCUMENTS 4,734,734 A * 3/1988 Yano ..... 399/186
4,966,439 A 10/1990 Althaus et al. ..... 359/820
5,337,074 A 8/1994 Thornton ..... 347/247
5,834,893 A * 11/1998 Bulovic et al. ..... 313/506
5,936,347 A * 8/1999 Isaka et al. ..... 313/509
6,072,517 A * 6/2000 Fork et al. ..... 347/237
6,577,332 B1 * 6/2003 Osawa et al. ..... 347/241
6,731,322 B1 * 5/2004 Hori ..... 347/238
6,803,939 B1 * 10/2004 Shimizu et al. ..... 347/238
6,825,867 B1 * 11/2004 Koga et al. ..... 347/238
2001/0028506 A1 10/2001 Fujimoto et al. ..... 359/622
2001/0052926 A1 12/2001 Hori ..... 347/238
2002/0057324 A1 5/2002 Vackier et al. ..... 347/130
2004/0179088 A1 * 9/2004 Wong et al. ..... 347/238

FOREIGN PATENT DOCUMENTS

JP 10-12377 1/1998
JP 10-55890 2/1998
JP 11-198433 7/1999
JP 2000-77188 3/2000
JP 2000-323276 11/2000
JP 2001-18441 1/2001
JP 2001018448 A * 1/2001
JP 2001-356422 12/2001

* cited by examiner

*Primary Examiner*—Hai Pham
(74) *Attorney, Agent, or Firm*—Sughrue Mion, PLLC

(57) ABSTRACT

The present invention relates to a small optical writing head, such as an organic EL array exposure head, having long work distance with little crosstalk, a method of manufacturing the same, and an image forming apparatus using the same. The optical writing head is an optical writing head which projects fluxes of modulated light from light-emitting parts 2 of a light-emitting element array such as an organic EL array or fluxes of modulated light transmitted through shutter parts 2 of an optical shutter element array onto an image carrier 11 to form a predetermined pattern on the image carrier 11. The optical writing head comprises ball lenses 10 which are arranged such that the alignment of the ball lenses 10 corresponds to the alignment of the light-emitting parts 2 of the light-emitting element array or the shutter parts 2 of the optical shutter element array.

1 Claim, 16 Drawing Sheets

OPTICAL WRITING HEAD SUCH AS ORGANIC EL ARRAY EXPOSURE HEAD, METHOD OF MANUFACTURING THE SAME, AND IMAGE FORMING APPARATUS USING THE SAME

BACKGROUND OF THE INVENTION

The present invention relates to an optical writing head such as an organic electroluminescence (EL) array exposure head, a method of manufacturing the same, and an image forming apparatus using the same. More particularly, the present invention relates to an optical writing head comprising ball lenses arranged corresponding to elements of a light emitting element array such as organic EL array or a light shatter element array for condensing fluxes of light from the elements onto a photoreceptor, a method of manufacturing the same, and an image forming apparatus using the same.

The present invention also relates to an organic EL array exposure head which is designed to prevent crosstalk between pixels, and an image forming apparatus using the same.

Conventionally, various techniques of using an organic EL array as an exposure head for image forming apparatus have been proposed. Those concerned therewith are as follows.

In Japanese Patent Unexamined Publication No. H10-55890, an organic EL array as a whole is fabricated on an insulating substrate made of glass, and a separate driver IC is combined with the organic EL array. A condensing rod lens array is used to condense light-emitting parts of the organic EL array to form an image on a photosensitive drum.

Japanese Patent Unexamined Publication No. H11-198433 uses a one-chip organic EL array having a plurality of rows. However, the optical system for condensing the light-emitting parts to form an image on a photosensitive drum is not clear. It should be noted that an EL layer of the organic EL array is deposited by evaporation.

In Japanese Patent Unexamined Publication No. 2000-77188, microlenses are formed on the top surface of a substrate by an ion exchange method. Alternatively, microlenses are formed on the bottom surface of a substrate by a method using a photoresist or by a replica method. An organic EL array having a resonator structure is deposited in alignment with the microlenses by evaporation.

Japanese Patent Unexamined Publication No. H10-12377 relates to a method of producing an active matrix organic EL display. An organic light-emitting layer is formed by the inkjet method over a glass substrate having thin-film transistors.

In Japanese Patent Unexamined Publication No. 2000-323276, a barrier plate is formed and coating is conducted by the inkjet method so as to form a hole injection layer and an organic light-emitting layer of an organic EL element.

In Japanese Patent Unexamined Publication No. 2001-18441, a light-emitting layer and a TFT layer for controlling light emission from the light-emitting layer are formed in a photosensitive drum. In this manner, a printer is manufactured.

On the other hand, various techniques of using a light emitting diode (LED) array or a liquid crystal shatter array, besides an organic EL array, as an exposure head for image forming apparatus have been also proposed. In these cases, a condensing rod lens array is generally used to condense fluxes of light from light-emitting parts of the LED array or from shutter parts of the liquid-crystal shutter array onto a photosensitive drum.

When an organic EL array is used as an exposure head of a printer such as an electrophotographic printer, in case of using a condensing rod lens array for condensing fluxes of light from light-emitting parts of the organic EL array or the LED array or from shutter parts of the liquid-crystal shutter array onto a photosensitive drum, the exposure head requires long optical path length and thus needs increase in size. In addition, since the condensing rod lenses are not arranged in a one-on-one relation to the light-emitting parts or the shutter parts, periodical optical irregularity occurs. Moreover, since the condensing rod lens requires advanced manufacturing technology, the increase in cost is inevitable. In case that the organic EL array is integrated with microlenses, there are problems such as a restriction in usable microlens materials.

In case of using a microlense array, though the microsenses are arranged in a one-on-one relation to light-emitting parts, such crosstalk in which light from a light-emitting part is incident on a pixel position through a microlens, not a microlens corresponding to the light-emitting part, e.g. a microlens adjacent to the corresponding microlens easily occurs, thus leading to the reduction in resolution.

The present invention was made to overcome the aforementioned problems of conventional techniques. The first object of the present invention is to provide a small optical writing head having long work distance with little crosstalk and which comprises ball lenses which are arranged in a one-on-one relation to elements of a light-emitting element array such as an organic EL array and an LED array or an optical shutter element array such as a liquid-crystal shutter array to condense fluxes of light from the elements onto an image carrier of a photoreceptor, a method of manufacturing the same, and an image forming apparatus using the same.

The second object of the present invention is to provide a small exposure head which comprises microlenses in a one-on-one relation to elements of an organic EL array to condense fluxes of light from the elements onto an image carrier such as a photoreceptor with little crosstalk, enough resolution and contrast.

The first object is achieved by providing an optical writing head for projecting fluxes of modulated light from light-emitting parts of a light-emitting element array or fluxes of modulated light transmitted through shutter parts of an optical shutter element array onto an image carrier to form a predetermined pattern on the image carrier, wherein the optical writing head is characterized by comprising ball lenses which are arranged such that the alignment of the ball lenses corresponds to the alignment of the light-emitting parts of the light-emitting element array or the shutter parts of the optical shutter element array.

In this case, it is preferable that the ball lenses are fixed to a transparent member on the surface of the light-emitting element array or the optical shutter element array by transparent adhesive.

It is also preferable that the diameter of the ball lenses is equal to or less than the alignment pitch of the light-emitting parts of the light-emitting element array or the alignment pitch of the shutter parts of the optical shutter element array.

It is also preferable that the refractive index of the ball lenses is equal to or more than the refractive index of the transparent adhesive.

It is also preferable that the thickness of the transparent member is equal to or less than the diameter of the ball lenses.

It is preferable that the optical writing head further comprises a light-shielding mask arranged among the ball lenses.

In this case, the light-shielding mask may be a light-shielding mask plate formed with holes corresponding to the array of the ball lenses, wherein at least either of the positioning and the fixing of the ball lenses is achieved by the light-shielding mask plate which is disposed on the output side of the ball lenses.

For example, the light-emitting element array may be an organic EL array.

The method of manufacturing the optical writing head of the present invention, which is for projecting fluxes of modulated light from light-emitting parts of a light-emitting element array or fluxes of modulated light transmitted through shutter parts of an optical shutter element array onto an image carrier to form a predetermined pattern on the image carrier and which comprises ball lenses which are arranged such that the alignment of the ball lenses corresponds to the alignment of the light-emitting parts of the light-emitting element array or the shutter parts of the optical shutter element array, is characterized in that the alignment of the ball lenses is achieved by forming a pattern of holes for positioning the ball lenses to positions corresponding to the light-emitting parts of the light-emitting element array or the shutter parts of the optical shutter element array on a transparent member on the surface of the light-emitting element array or the optical shutter element array, and fitting the ball lenses into the holes.

In this case, the pattern of holes may be composed of a member which also functions as a light-shielding means.

The present invention also pertains to an image forming apparatus using an optical writing head as described above as an exposure head for writing an image on an image carrier.

An example of such image forming apparatus is a color image forming apparatus of a tandem type having at least two image forming stations each comprising a charging means, an exposure head, a developing means, and a transfer means which are arranged around an image carrier, wherein the color image forming apparatus forms a color image by passing a transfer medium through the respective stations.

An organic EL array exposure head of the present invention for achieving the second object comprises a long substrate and an array of organic EL elements aligned just like pixels aligned in at least of one row and is characterized by comprising a barrier plate formed with optical holes for preventing crosstalk of light, i.e. a phenomenon that fluxes of light emitted from the light-emitting parts of adjacent organic EL elements are immixed at the condensing position of light from the light-emitting part of either organic EL element, wherein the barrier plate is arranged on the output side of the array of the organic EL elements.

In this case, it is preferable that plus lenses are arranged at positions of the holes of the barrier plate, respectively.

It is also preferable that the coefficient of linear expansion of the substrate and the coefficient of linear expansion of the barrier plate are substantially equal to each other.

The barrier plate may be a metal plate formed with holes or a barrier plate made of a resin with holes which is formed by molding.

The barrier plate and the substrate may be integrally formed.

The level of the output-side surface of the barrier plate may be higher or lower than the level of the plus lenses.

It is preferable that the inner surface of the each hole of the barrier plate has light reflectivity or light absorptivity.

The plus lenses may be made of a resin. In this case, the plus lenses are formed within the holes of the barrier plate by the inkjet method or by a molding (replica) method Further, the plus lenses may be made of glass.

Furthermore, the plus lenses may be ball lenses.

In addition, the each organic EL element may be either of cases of emitting light from its anode side and emitting light from its cathode side.

Moreover, the each organic EL element may be of a polymer type or of a low-molecular type.

It is preferable that the light emission of the each organic EL element is controlled by a TFT disposed on the substrate.

The present invention also pertains to an image forming apparatus using an organic EL array exposure head as described as an exposure head for writing an image on an image carrier.

An example of such image forming apparatus is a color image forming apparatus of a tandem type having at least two image forming stations each comprising a charging means, an exposure head, a developing means with toner, and a transfer means which are arranged around an image carrier, wherein the color image forming apparatus forms a color image by passing a transfer medium through the respective stations.

In case of an image forming apparatus of a type developing an image by a developing means with toner, it is preferable to satisfy both the following relations:

$$|\Phi_T - \Phi_L| \leq 0.2 \text{ eV} \quad (1)$$

$$|\Phi_T - \Phi_B| \geq 0.5 \text{ eV} \quad (2)$$

wherein $\Phi_L$ is the work function of the material for the plus lenses, $\Phi_B$ is the work function of the material of the barrier plate, and $\Phi_T$ is the work function of the material of toner.

In the optical writing head of the present invention achieving the first object, the ball lenses are arranged such that the alignment of the ball lenses corresponds to the alignment of the light-emitting parts of the light-emitting element array or the shatter parts of the optical shutter element array, thereby preventing the occurrence of periodical optical irregularity which has been conventionally occurred due to use of condensing rod lenses. In addition, the reduction in size of the optical writing head can be achieved and enough work distance can be ensured.

Further, in the optical writing head of the present invention achieving the second object, the barrier plate, having optical holes for preventing crosstalk of light i.e. a phenomenon that fluxes of light emitted from the light-emitting parts of adjacent organic EL elements are immixed at the condensing position of light from the light-emitting part of either organic EL element, is provided on the light-emitting side of the array of organic EL elements, thereby reducing the crosstalk between adjacent pixels and thereby obtaining enough resolution and contrast.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Hereinafter, an optical writing head achieving the first object of the present invention and a method of manufacturing the same will be described with regard to embodiments.

Figure 1:
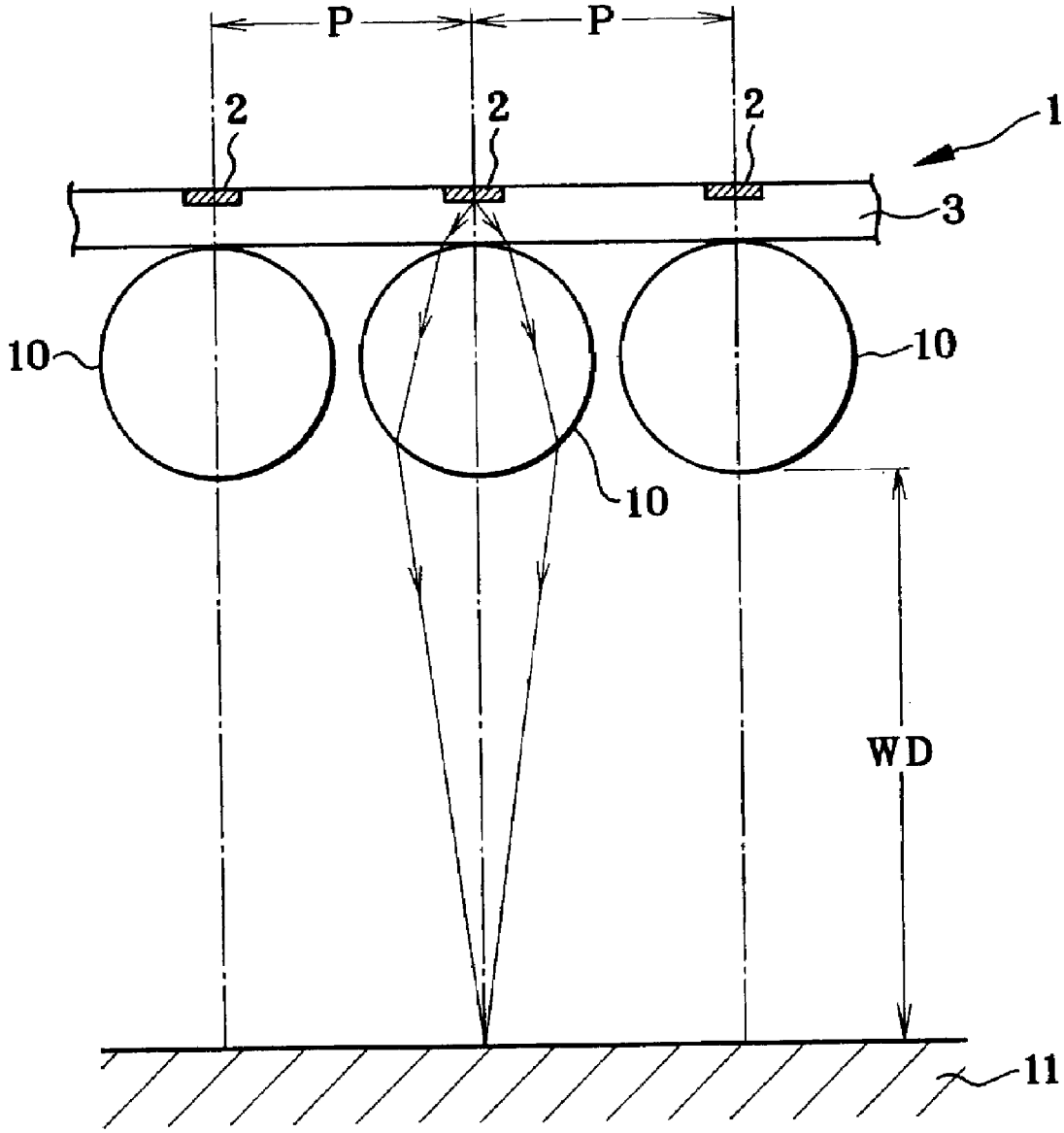
FIG. 1 is a sectional view schematically showing the basic structure of an optical writing head achieving the first object according to the present invention.

FIG. 1 is a sectional view schematically showing the basic structure of the optical writing head according to the present invention, in which light-emitting parts 2 such as organic EL and LED or shutter portions 2 such as a liquid crystal shutter are placed on the surface of or in a transparent layer 3 at constant interval, thereby forming a light-emitting element array 1 or an optical shutter element array 1. In case of the optical shutter element array 1, the shutter parts 2 per se do not emit light. However, light sources (backlight) are disposed behind the shatter parts 2 so that the shutter parts 2 function as secondary light source. Therefore, in the following description except for special explanation, the shutter parts 2 will be called the light-emitting parts 2 and, in addition, the light-emitting element array 1 and the optical shutter element array 1 will be called generally an optical modulation element array 1.

According to the present invention, ball lenses 10 having the same shape and characteristics are arranged in a one-on-one congruent positional relation to the light-emitting parts 2 of the light modulation element array 1. In FIG. 1, the ball lenses 10 are placed to abut on a surface, opposite a surface provided with the light-emitting parts 2, of the transparent layer 3 composing the light modulation element array 1 and are arranged such that the centers of the ball lenses 10 are aligned with the centers of the light-emitting parts 2, respectively. Further, the ball lenses 10 are arranged such that a flux of light from each light-emitting part 2 through the transparent layer 3 is condensed by each lens 10 of a predetermined magnifications onto an image carrier 11 such as a photoreceptor (in case of an electrophotographic device) as a projected object.

It should be noted that the ball lens 10 is a single plus lens composed of a transparent sphere and has a focal length which is determined by the refractive index of the transparent sphere, the refractive index of the surrounding ambience, and the radius of the transparent sphere.

Therefore, the diameter of the ball lens 10, the distance from the light-emitting part 2 to the ball lens 10 (the thickness of the transparent layer 3, in case of FIG. 1), and the refractive index between the transparent layer 3 and the ball lens 10 are suitably selected to ensure the distance (work distance) WD from the surface on the emitting side of the ball lens 10 to the image carrier 11 for achieving the projection onto the image carrier 11 with enough resolution by a one-on-one relation between the light-emitting pats 2 of the optical modulation element array 1 and the ball lenses 10.

Figure 2:
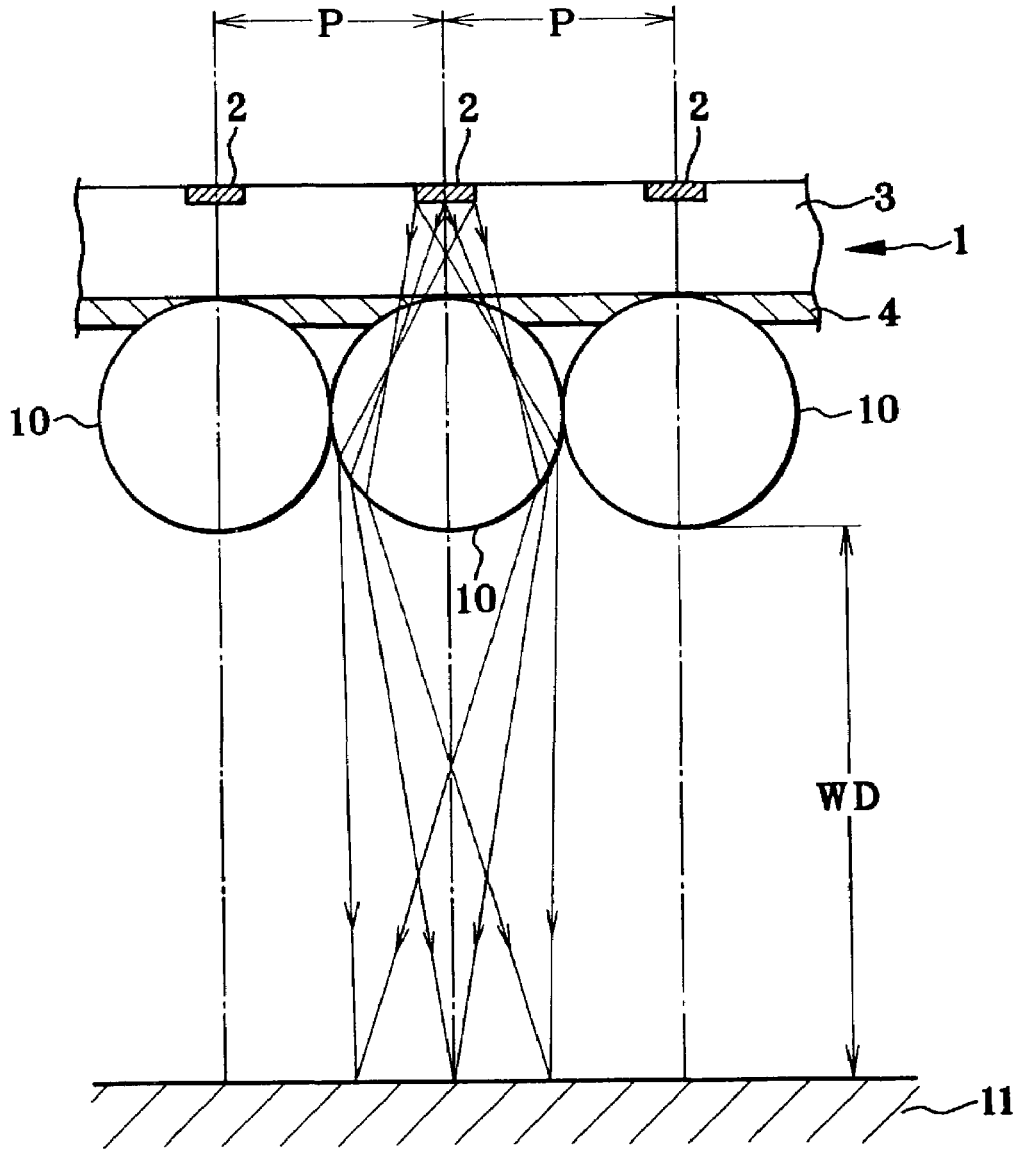
FIG. 2 is a sectional view showing a case of using transparent adhesive for fixing ball lenses.

FIG. 2 is a sectional view showing a case of using transparent adhesive for fixing ball lenses 10 to the surface of the transparent layer 3 on the opposite side of the light-emitting portions 2. The ball lenses 10 are fixed to the surface of the transparent layer 3 by a transparent adhesive layer 4 at positions corresponding to the light-emitting parts of the optical modulation element array 1 in a one-on-one relation. In the case of FIG. 2, since the diameter of each lens is set to be equal to the alignment pitch "p" of the light emitting parts 2, the positioning of the ball lenses 10 relative to the light-emitting parts 2 is conducted by the contacts between the ball lenses 10, i.e. the outer profiles of the ball lenses 10. It should be understood that the diameter of each ball lens 10 must be equal to or less than the alignment pitch "p" of the light-emitting parts.

Though there are no particular limitations on refractive index of the transparent adhesive layer 4 supporting the ball lenses 10 on the opposite side of the light-emitting parts 2 relative to the optical modulation element array 1, the refractive index of the transparent adhesive layer 4 is preferably equal to or less than the refractive index of the ball lens 10. When this refractive index relation is selected, a spherical surface on the input side of the ball lens functions as a refractive surface with a plus refractive power. Therefore, the ball lenses 10 can be positioned further close to the light-emitting parts 2 (in order to obtain the same work distance WD, the shorter the focal length, the shorter the object distance). Then, the NA (numerical aperture) of flux of incident light of the ball lens 10 is increased, whereby the crosstalk in which flux of light emitted from the light-emitting portion 2 is incident on a not-corresponding pixel position through a ball lens 10 adjacent to the corresponding ball lens 10 can be reduced, thereby obtaining an optical writing head having high resolution.

Though there are no particular limitations on thickness of the transparent layer 3 defining the distance between the light-emitting part 2 and the ball lens 10, the thickness of the transparent layer 3 is preferably equal to or less than the diameter of the ball lens 10. That is, since the crosstalk in which flux of light emitted from the light-emitting portion 2 is incident on a not-corresponding pixel position through a ball lens 10 adjacent to the corresponding ball lens 10 is reduced as the NA of the flux of light incident on the ball lens 10 is higher, the thinner transparent layer is better. That is, the thickness of the transparent layer 3 is preferably equal to or less than the diameter of the ball lens 10.

By the way, among possible ways of positioning the ball lenses 10 to correspond to the light-emitting parts 2 of the optical modulation element array 1 in a one-on-one relation, one is selecting the alignment pitch "p" of the light-emitting parts 2 to be equal to the diameter of each ball lens 10 as shown in FIG. 2. There is another way by interposing a spacer 5, having holes 6 into which the ball lenses 10 are fitted, respectively, between the transparent layer 3 to which the ball lenses 10 are fixed and the ball lenses 10 as shown in a sectional view of FIG. 3(*a*) and a bottom plan view of FIG. 3(*b*). The holes 6 are formed with the same pitch as the alignment pitch "p" of the light-emitting parts 2. The diameter of each hole 6 is determined by the diameter of each ball lens 10 and the thickness of the spacer 5. The shape of the hole 6 may be not always circle, that is, may be a square, a regular hexagon, or the like. The spacer 5 is preferably formed by photolithography using photoresist. The ball lens 10 fitted in the hole 6 may be fixed with transparent adhesive as shown in FIG. 2 or alternatively mechanically fixed as described later.

Figure 4A:
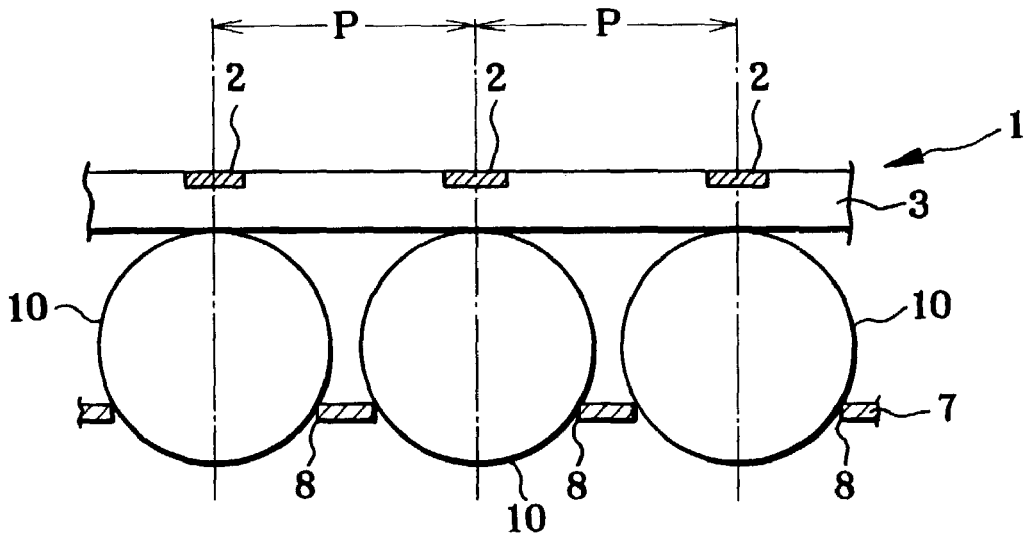
FIGS. 4(*a*), 4(*b*) are a sectional view and a plan view showing a case of providing a light-shielding mask plate for shielding crosstalk light.
Figure 4B:
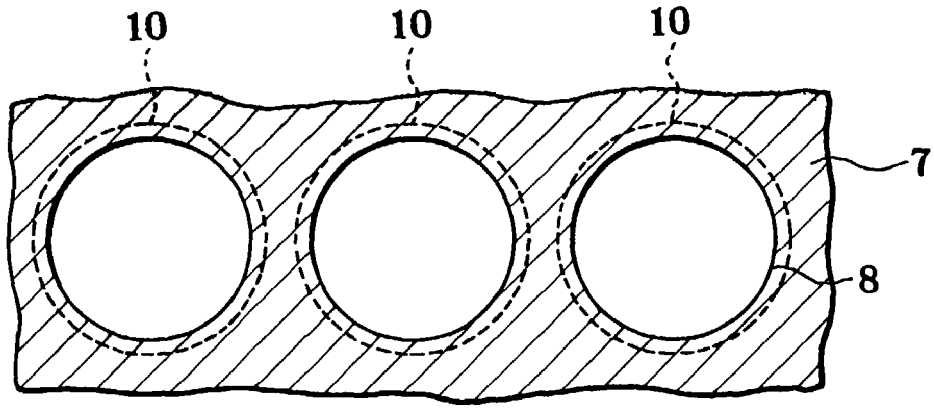

FIGS. 4(*a*), 4(*b*) show another embodiment. FIG. 4(*a*) is a sectional view, FIG. 4(*b*) is a plan view taken from the bottom of the FIG. 4(*a*). This embodiment employs a light-shielding mask plate for shielding crosstalk light over the ball lenses 10. The light-shielding mask plate 7 has holes 8 through which parts of the ball lenses 10 (parts of spherical surface on the output side in the illustrated case) are exposed. The holes 8 are formed with the same pitch as the alignment pitch "p" of the light-emitting parts 2. The light-shielding mask plate 7 is arranged among the ball lenses 10 which are aligned corresponding to the light-emitting parts 2 of the optical modulation element array 1 in a one-on-one relation. The light-shielding mask plate 7 shields and absorbs crosstalk light to be incident on a not-corresponding pixel position through a ball lens 10 adjacent to the corresponding ball lens 10, thereby reducing the crosstalk and thus obtaining an optical writing head having high resolution. It should be noted that the best shape of the holes 8 of the light-shielding plate 7 is circle.

In this embodiment, the light-shielding mask plate 7 may be placed between the input side spherical surfaces of the ball lenses 10 and the transparent layer 3. In case of placing the light-shielding mask plate 7 over the output-side spherical surfaces of the ball lenses 10 as shown in FIGS. 4(*a*) and 4(*b*), the light-shielding mask plate 7 should be made of a material having relatively high mechanical rigidity and the light-shielding mask plate 7 is pressed against the optical modulation element array 1 to impart mechanical force, whereby the light-shielding mask plate 7 has positioning function and fixing function.

Figure 3A:
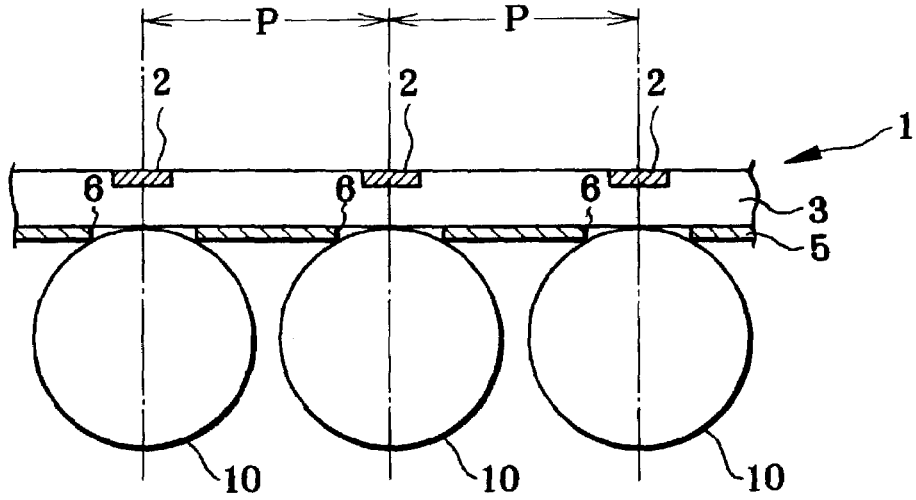
FIGS. 3(*a*), 3(*b*) are a sectional view and a plan view showing a case of providing a spacer having a hole alignment pattern for positioning the ball lenses.
Figure 3B:
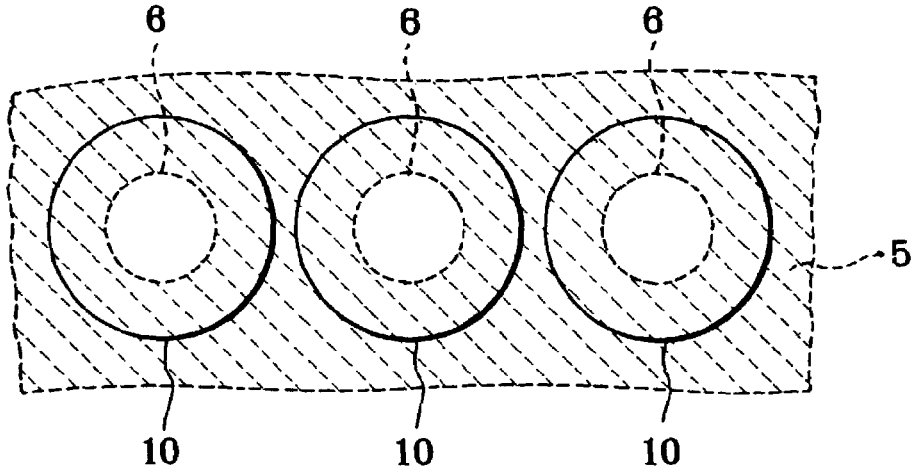

In the structure shown in FIGS. 3(*a*), 3(*b*), the spacer 5 may be made of a material having light blocking effect so that the spacer 5 can also function as a light-shielding means.

Now, an embodiment of an optical writing head employing an organic EL array according to the present invention will be described on the basis of its manufacturing method.

Figure 5A:
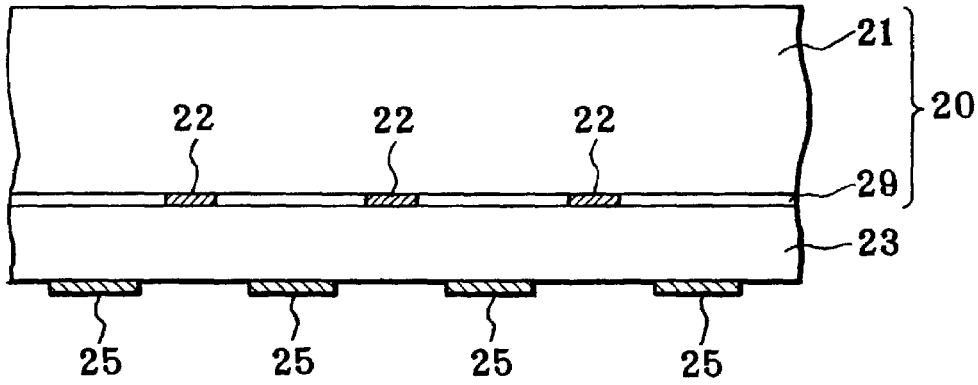
FIGS. 5(*a*), 5(*b*) are illustrations for explaining a method of manufacturing an embodiment of an optical writing head using an organic EL array according to the present invention.
Figure 5B:
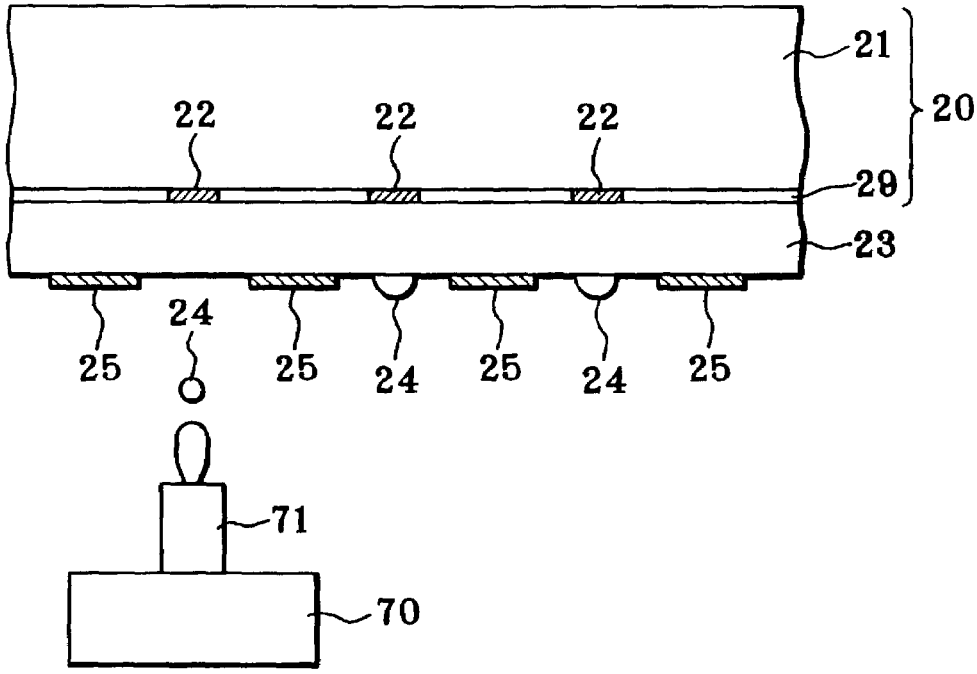

As shown in a sectional view of FIG. 5(*a*), an organic EL array 20 is prepared by forming organic EL light-emitting parts 22 with a constant pitch on a glass substrate 21 on which a TFT has been fabricated. The organic EL light-emitting parts 22 are formed by a method utilizing the inkjet method as will be described later. In FIGS. 5(*a*), 5(*b*), a numeral 29 designates a barrier plate (bank) arranged among the organic EL light-emitting parts 22.

The organic EL array 20 is covered with a transparent member 23 having a function of protecting the organic EL light-emitting parts 22.

After that, the transparent member 23 is coated with a black resist made of a photosensitive resin having light blocking property and holes are formed at positions corresponding to the organic EL light-emitting parts 22, thereby forming a light-shielding pattern layer 25.

Then, as shown in FIG. 5(*b*), transparent adhesive 24 of a UV cure type or a thermosetting type is dropped from a head 71 of an inkjet printing device 70 into holes of the light-shielding pattern layer 25.

Figure 6:
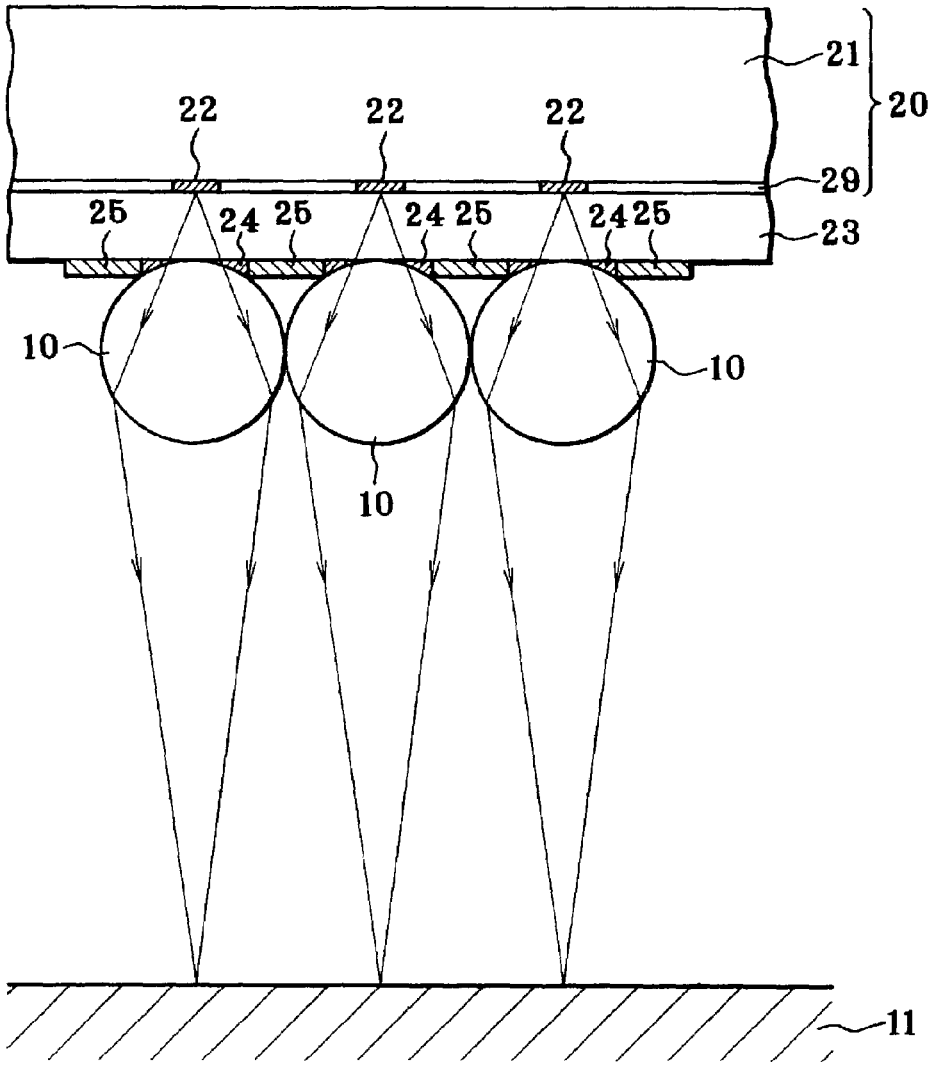
FIG. 6 is a sectional view showing the optical writing head using an organic EL array obtained by the manufacturing method as shown in FIGS. 5(*a*) and 5(*b*)

After that, as shown in FIG. 6, ball lenses 10 made of glass are aligned to be fitted into the respective holes of the light-shielding pattern layer 25. In this state, the transparent adhesive 24 between the transparent member 23 and the ball lenses 10 is cured by irradiating UV light or heating the entire surface.

In this manner, the optical writing head employing the organic EL array as shown in FIG. 6 is prepared.

The dimension and the refractive indexes of the respective parts of this embodiment are as follows:

Size of each organic EL light-emitting part 22: square 20 μm on a side

Pitch and alignment of the organic EL light-emitting parts 22: aligned in two rows in a zigzag fashion with 80 μm pitch, for pixel pitch of 40 μm on the photoreceptor Thickness of the transparent member 23: 20 μm Refractive index of the transparent member 23: 1.52

Thickness of the light-shielding pattern layer 25: 2.5 μm

Hole diameter of the light-shielding pattern layer 25: 40 μm

Transparent adhesive 24: UV cure resin, refractive index 1.52

Diameter of each ball lens 10: a little less than 80 μm

Refractive index of each ball lens 10: 1.69 (glass: SF8)

WD from the ball lenses 10 to the image carrier (photoreceptor) 11: 300 μm Magnification: approximately 4×

Figure 7:
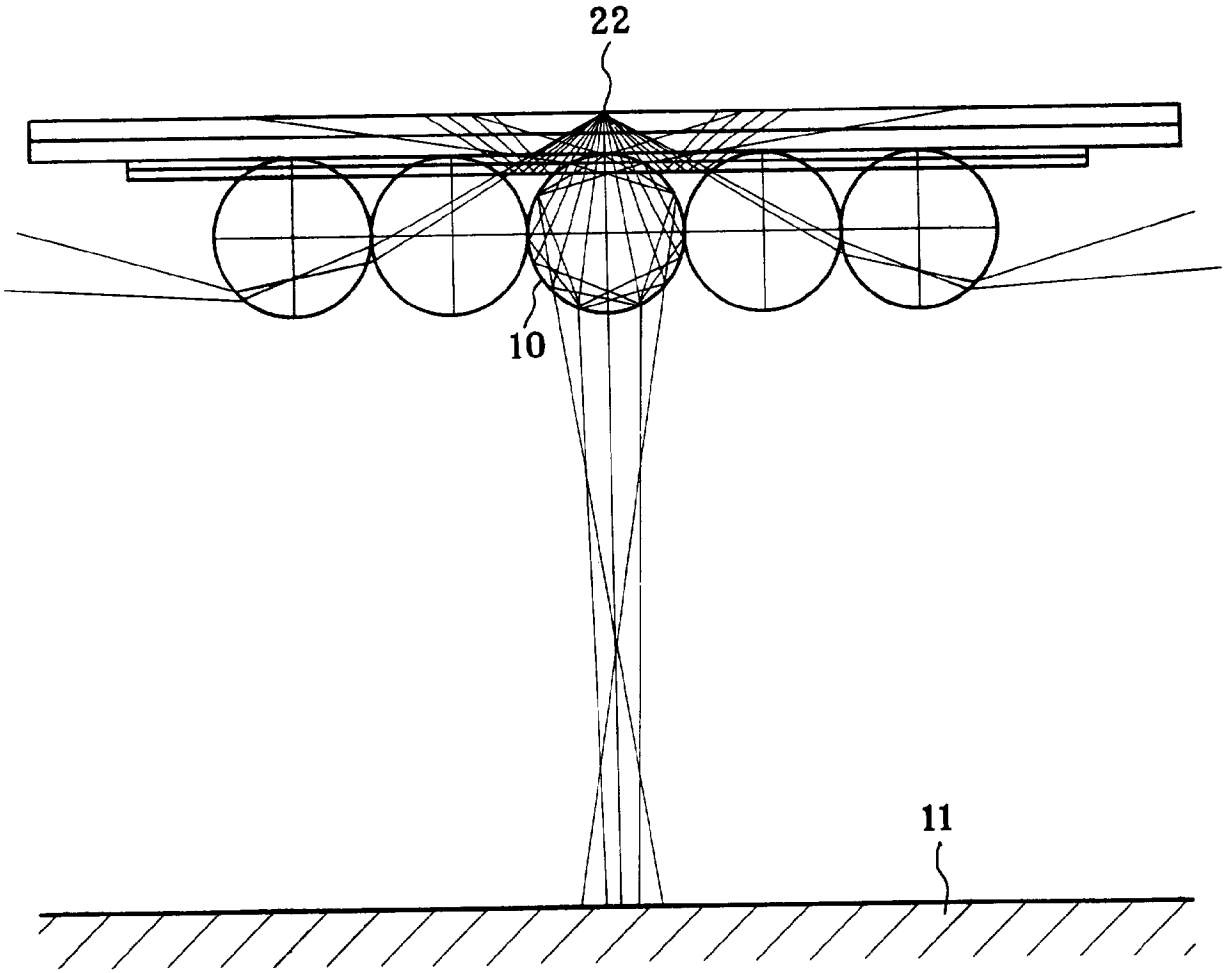
FIG. 7 is an illustration showing optical path tracing of the optical writing head of the embodiment shown in FIGS. 5(*a*)-6.
Figure 8:
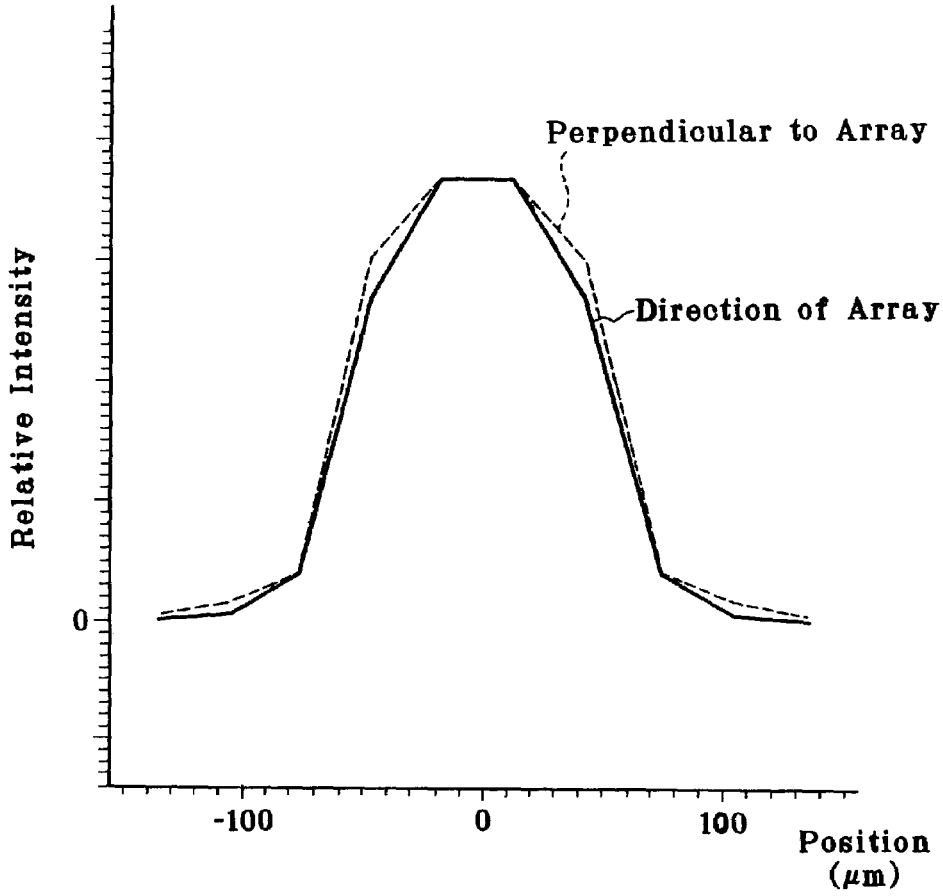
FIG. 8 is a distribution diagram of luminous energy of the optical writing head of the embodiment shown in FIGS. 5(*a*)-6.
Figure 9:
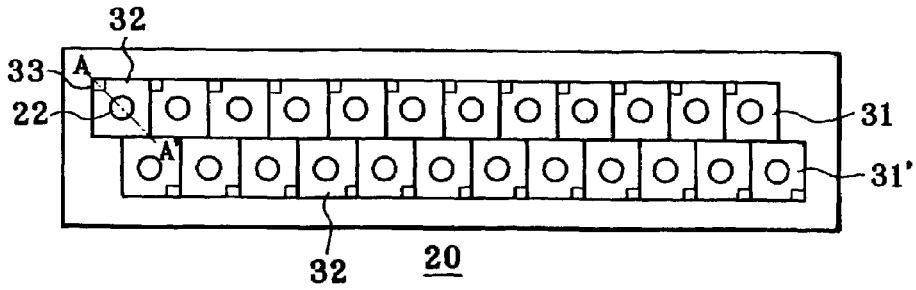
FIG. 9 is a plan view of the organic EL array used in the embodiment shown in FIGS. 5(*a*)-6.

FIG. 7 is an illustration showing optical path tracing of this embodiment and FIG. 8 is a distribution diagram of luminous energy of this embodiment.

The method of manufacturing the organic EL array 20 used in the aforementioned embodiment will be briefly described.

The organic EL array 20 has two arrays 31, 31' parallel to each other such that pixels in different arrays are arranged in a zigzag fashion. Each array 31, 31' comprises a plurality of pixels 32 aligned linearly. These pixels 32 are same in structure and each comprises an organic EL light-emitting part 22 and a TFT (thin-film transistor) 33 for controlling the emission of light of the organic EL light-emitting part 22.

Figure 10:
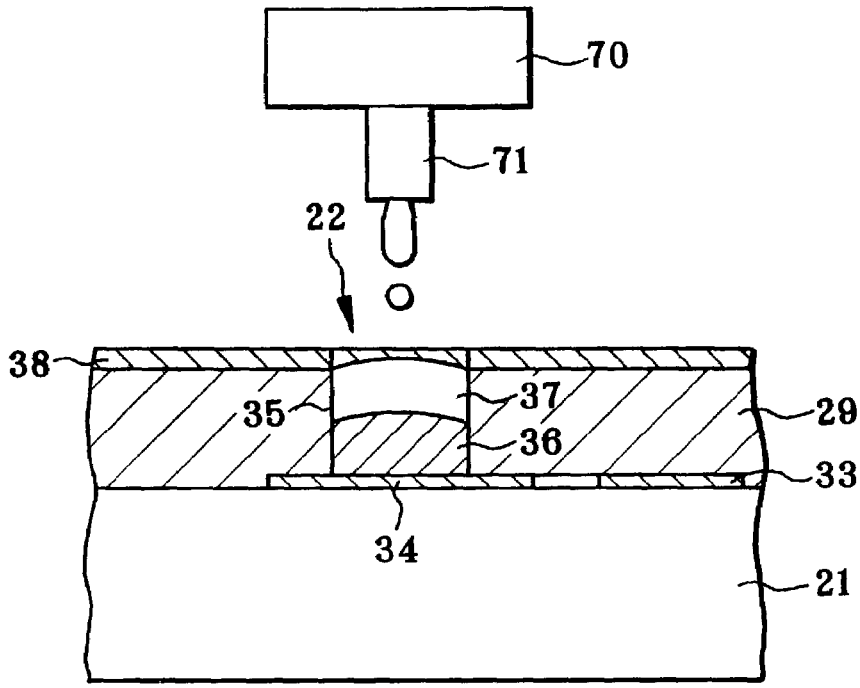
FIG. 10 is a sectional view showing one pixel in the array shown in FIG. 9.

FIG. 10 is a sectional view showing one pixel 32 including the organic EL light-emitting part 22 and the TFT 33. The pixel will be described in its preparing order. First, a TFT 33 is made on a glass substrate 21. There are known various methods of making the TFT 33. For example, silicon oxide is first deposited into a layer on the glass substrate 21 and amorphous silicon is then deposited into a layer thereon. Excimer laser beam is exposed to the amorphous silicon layer to crystallize to form a polysilicon layer as a channel. After patterning the polysilicon layer, a gate insulating layer is formed and further a gate electrode is formed of tantalum nitride. Subsequently, source/drain regions for N-channel TFT are formed by ion implantation of phosphorous and source/drain regions for P-channel TFT are formed by ion implantation of boron. After impurities of ion implantation is activated, a first interlayer insulation film is deposited, first contact holes are formed, source lines are formed, a second interlayer insulation film is deposited, second contact holes are formed and metallic pixel electrodes are formed, thereby completing the array of TFT 33 (for example, see "Polymer Organic EL Display" presented at the $8^{th}$ Electronic Display Forum (Apr. 18, 2001)). The metallic pixel electrode is a metal membrane electrode of a metal such as Mg, Ag, Al, and Li and functions as a cathode 34 for the organic EL light-emitting part 22 and also as a reflection layer for the organic EL light-emitting part 22.

Then, a barrier plate 29 of a predetermined height is formed to have holes 35 corresponding to the organic EL light-emitting parts 22. The barrier plate 29 may be formed by any suitable method such as a photolithographic technique, a printing technique, and so on as disclosed in Japanese Patent Unexamined Publication No. 2000-353594. In case of using the photolithographic technique, an organic material is applied by a suitable method such as a spin coating method, a spray coating method, a roll coating method, a die coating method, and a dip coating method to have height corresponding to the height of the barrier plate 29, and a resist layer is formed thereon. Parts of the resist layer corresponding to the shape of the barrier plate 29 are coated with masking. The resist layer is exposed and developed, thus leaving the parts of the resist layer corresponding to the configuration of the barrier plate 29. Finally, the organic material is etched, thereby removing parts of the organic material not coated with the masking. The bank (convex portion) may be formed of two layers of which the lower layer is made of inorganic material and the upper layer is made of organic material. As disclosed in Japanese Patent Unexamined Publication No. 2000-323276, the material of the barrier plate 29 is any material having resistance against the solvent for the EL material and there are no other particular limitations on selection of the material. However, organic materials such as acrylic resin, epoxy resin, and photosensitive polyimide are preferable because these can be treated by fluorocarbon gas plasma treatment to have Teflon-like characteristics. The bank may be a laminated barrier plate having a lower layer made of inorganic material such as liquid glass. It is preferable to mix carbon black into the aforementioned material to have a black or opaque barrier plate 29.

Immediately before applying ink composition as a material of light-emitting layer of the organic EL, the substrate with the barrier plate 29 is treated by continuity of oxygen gas plasma and fluorocarbon gas plasma. By this treatment, the polyimide surface of the barrier plate 29 is changed to have water repellency and the surface of the cathode 34 is changed to have hydrophilicity. In addition, the wettability of the substrate required for finely patterning inkjet drops can be controlled. The device for producing plasma used for this treatment may be a device which produces plasma in vacuo or a device which produces plasma in the atmosphere.

An ink composition as a material of light-emitting layer is discharged into the hole 35 of the barrier plate 29 from a head 71 of an inkjet printing device 70, thereby achieving the patterning application on the cathode 34 of the pixel. After the application, the solvent is removed and the applied ink composition is treated by heat, thereby forming a light-emitting layer 36.

Figure 11:
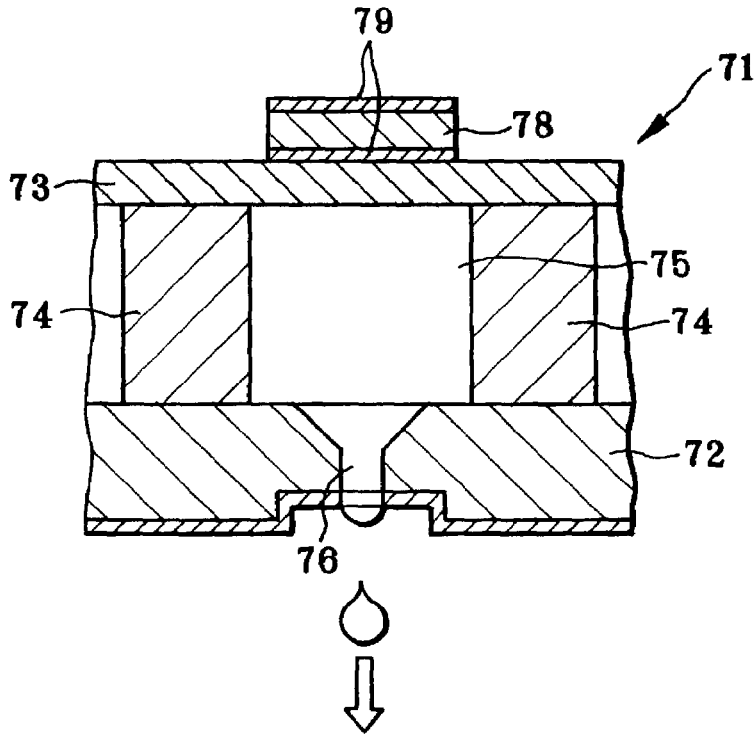
FIG. 11 is an illustration showing an example of a head of a type using a piezo ink jet technology among inkjet technologies.
Figure 12:
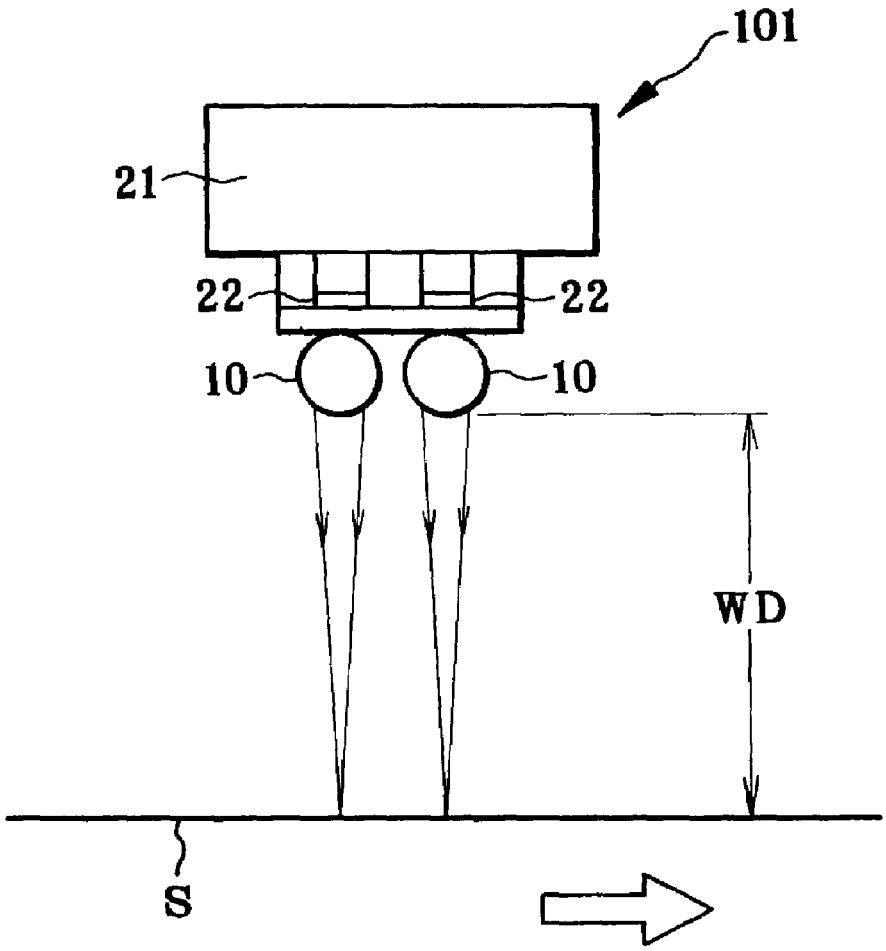
FIG. 12 is a side view showing the aspect of light condensation of the optical writing head of the embodiment shown in FIGS. 5(*a*)-6.

It should be noted that the inkjet method used in the present invention may be of a type using a piezo ink jet method in which ink composition is pushed out by mechanical energy of a piezoelectric element or the like or of a type using a thermal method in which ink composition is heated to form bubbles by utilizing thermal energy of a heater so that the ink composition is forced out according the generation of bubbles (see "Fine Imaging and Hardcopy" compiled by the publishing committee composed of The Society of Photographic Science and Technology of Japan and The Imaging Society of Japan and issued at Jan. 7, 1999 (Corona Publishing Co. Ltd., p.43). FIG. 11 shows an example of a head of a type using a piezo ink jet method. The inkjet writing head 71 comprises a nozzle plate 72, for example, made of stainless steel and a diaphragm 73 which are connected via a partition member (reservoir plate) 74. Between the nozzle plate 72 and the diaphragm 73 a plurality of ink chambers 75 and ink reservoirs (not shown) are formed by the partition member 74. The ink chambers 75 and the ink reservoirs are filled with an ink composition and communicate with each other through respective supply ports. Further, the nozzle plate 72 is provided with nozzle openings 76 for-spraying the ink composition from the ink chambers 75 in the form of jets. The inkjet writing head 71 is formed with an ink inlet for supplying the ink composition to each reservoir. Piezoelectric elements 78 are connected to a surface of the diaphragm 73 opposite a surface thereof facing the ink chambers 75 at respective positions corresponding to the ink chambers 75. Each piezoelectric element 78 is positioned between a pair of electrodes 79. When energized, the piezoelectric element 78 is deflected so as to project outwardly. This causes the ink chamber 75 to increase in volume. Consequently, an amount of ink composition corresponding to the increase in volume of the ink chamber 75 flows into the ink chamber from the ink reservoir through the supply port. When deenergized, the piezoelectric element 78 returns to its original shape and the diaphragm 73 also returns to its original shape. Consequently, the ink chamber 75 also returns to its original volume. Therefore, the pressure of the ink composition in the ink chamber 75 increases, causing the ink composition to jet out through the nozzle opening 76 toward the substrate provided with the barrier plate 29.

After forming the light-emitting layer 36 within the hole 35, an ink composition as a material of hole injection layer is discharged onto the light-emitting layer 36 within the hole 35 from the head 71 of the inkjet printing device 70, thereby achieving the patterning application on the light-emitting layer 36 of the pixel. After the application, the solvent is removed and the applied ink composition is treated by heat, thereby forming a hole injection layer 37.

The light-emitting layer 36 and the hole injection layer 37 may be formed upside down. It is preferable to form a layer having resistance against moisture on a surface side (a side apart from the substrate 21).

The light-emitting layer 36 and the hole injection layer 37 may be formed by other known method such as a spin coating method, a dipping method, and a vapor deposition method instead of applying the ink composition by the inkjet method as the above.

The material of the light-emitting layer 36 and the material of the hole injection layer 37 maybe known materials listed in Japanese Patent Unexamined Publication H10-12377 and Japanese Patent Unexamined Publication 2000-323276, so description about details will be omitted.

After the light-emitting layer 36 and the hole injection layer 37 are individually formed in the hole 35 of the barrier plate 29, the entire surface of the substrate is coated with a transparent electrode 38 by vacuum vapor deposition. The transparent electrode 38 functions as an anode of the organic EL. The transparent electrode 38 is formed on and connected with the hole injection layer 37. The material of the transparent electrode 38 may be selected from a group including a tin oxide film, an indium tin oxide (ITO) film, a combined oxide film of an indium oxide and zinc oxide. Instead of the vacuum vapor deposition, other techniques including the photolithography, the spattering method, and the pyrosol method may be employed.

In this manner, the organic EL array 20 used in the embodiment shown in FIG. 5(*a*)-FIG. 8 is prepared.

The barrier plate 29 may be formed to have a larger thickness and deeper holes 35 formed therein. In this case, an organic EL light-emitting part 22 is formed in the bottom of each hole 35 and a transparent material or a transparent adhesive having protective function is deposited on the organic EL light-emitting part 22. Then, a ball lens 10 is fitted in an upper portion of the hole 35. In this manner, the ball lens 10 is fixed and aligned with the light-emitting part 22. In this structure, the transparent member 23 can be omitted.

By the way, the optical writing head 101 of the aforementioned embodiment according to the present invention condenses fluxes of light emitted from the organic EL light-emitting parts 22 on a surface S, spaced apart from the optical writing head 101 a work distance WD, into the same array pattern as that of the pixels of the head 101. Accordingly, a predetermined pattern can be recorded on the surface S by moving the surface S relative to the optical writing head 101 in a direction perpendicular to the longitudinal direction of the optical writing head 101 and, at the same time, controlling the light emission from the organic EL light-emitting parts 22 of the optical writing head 101 by the TFTs 33.

Hereinafter, an organic EL array head achieving the second object of the present invention will be described with regard to attached drawings.

Figure 13:
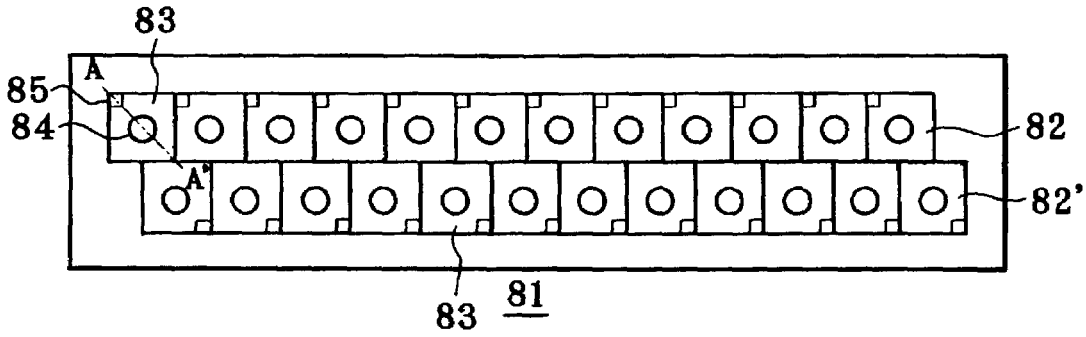
FIG. 13 is a schematic plan view of an embodiment of an organic EL array exposure head achieving the second object according to the present invention.
Figure 14:
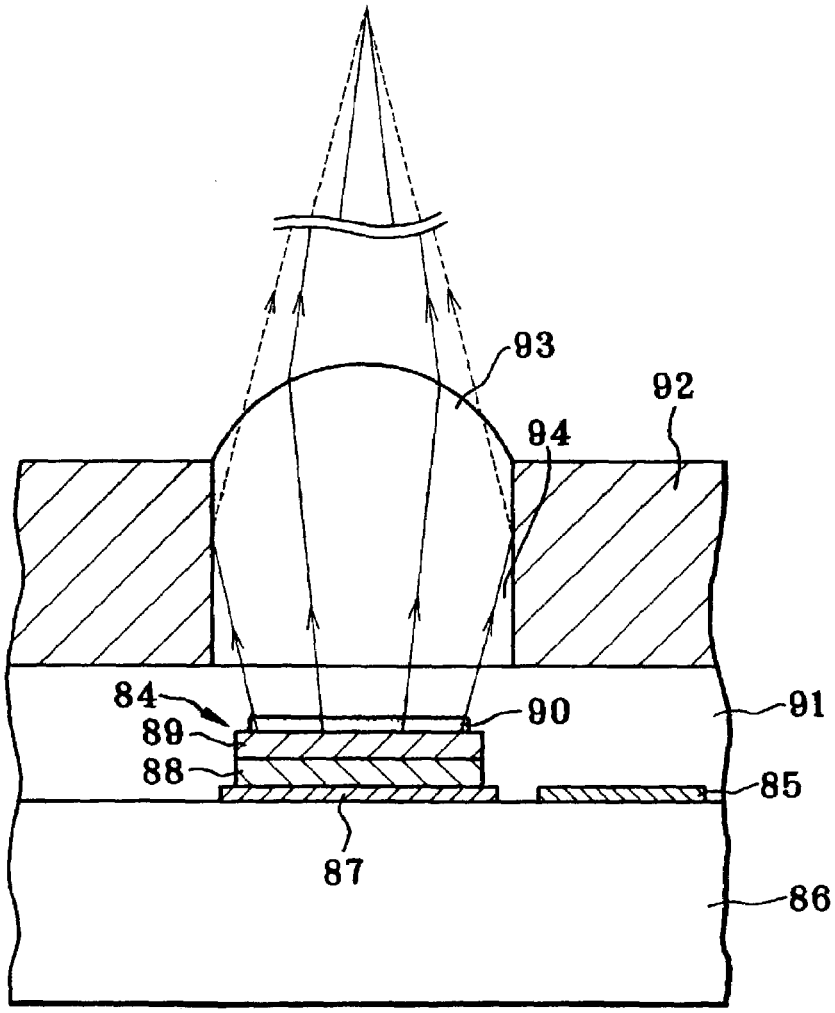
FIG. 14 is a sectional view showing one pixel of an organic EL element which is an example of a type emitting light from the cathode side thereof.

FIG. 13 is a schematic plan view of an embodiment of an organic EL array exposure head according to the present invention, and FIG. 14 is a sectional view showing one pixel of the array taken along a straight line A–A' of FIG. 13.

The organic EL array exposure head 81 of this embodiment has two arrays 82, 82' parallel to each other such that pixels in different arrays are arranged in a zigzag fashion. Each array 82, 82' comprises a plurality of pixels 83 aligned linearly. These pixels 83 are same in structure and each comprises an organic EL element 84 and a TFT 85 for controlling the emission of light of the organic EL element 84.

FIG. 14 is a sectional view showing one pixel 83 including the organic EL element 84 and the TFT 85. The organic EL element 84 is an example of a type emitting light from the cathode side thereof.

The organic EL element 84 emits light when electrons and holes recombine after being injected from a cathode 90 and an anode 87, respectively, and thus has a structure comprising a lamination of an light-emitting layer 89 as an electron transport layer and a hole injection layer 88.

Organic EL elements can be divided into a type in which light is emitted from the cathode and a type in which light is emitted from the anode. Common type is the type in which light is released from the anode i.e. from the substrate side (an organic EL element of this type will be described as an embodiment described later). The main reason of this is restriction on manufacturing. Because of the substrate-side emission, the material of the substrate is limited to transparent material such as glass and the driving circuit formed on the glass must be a TFT.

On the other hand, this embodiment is an organic EL element of a type in which light is emitted from the cathode side. Therefore, the cathode 90 has light transmittancy, while the anode 87 does not have light transmittancy but has light reflectivity, thereby exhibiting an effect of increasing the reflectance toward the cathode 90.

An organic EL array exposure head 81 comprises a plurality of light-emitting pixels 83 which are aligned, for example, in two arrays 82, 82' as shown in FIG. 13. Each pixel 83 comprises a substrate made of glass, silicon or the like, the anode 87 made of ITO (indium tin oxide), an alloy of magnesium and silver, or aluminum, the hole injection layer 88, the light-emitting layer 89, the cathode 90 being a metal electrode of which thickness is enough thin for allowing light transmission, an adhesive layer 91 made of a transparent resin, a microlens 93 functioning as a sealing member for preventing the deterioration of the light emitting layer 89 due to moisture and a condensing element, and a barrier plate 92 surrounding the microlens 93.

As will be explained later, when the organic EL array exposure head 81 is used as an exposure head for an electrophotographic full-color image forming apparatus, a photoreceptor is disposed to face the microlenses 93 so that fluxes of light emitted from the respective light-emitting pixels 83 are condensed into arrays on the photoreceptor by the action of the microlenses 93.

According to the basic manufacturing method and structure of the organic EL array exposure head 81 of this embodiment, an organic EL array composed of the organic EL elements 84 and the TFTs 85 aligned in arrays on the substrate 86 is prepared separately from an array composed of the microlenses 93 for condensing fluxes of light from theorganic EL elements 84. Then, the organic EL array and the array of the microlenses 93 are optically or mechanically joined to each other with the adhesive layer 91. The manufacturing method of the organic EL element 84 may be any known method. The respective layers 87, 88, 89, 90 are formed on the substrate 86 by vacuum vapor deposition, cast-coating, or the like. Alternatively, these may be formed by the inkjet method as disclosed in Japanese Patent Unexamined Publication No. H10-12377. As the material of the microlens 93 and the adhesive layer 91, an UV cure resin is the best in view of handling. However, the material is not limited thereto and may be any material having enough light transmittancy relative to the wavelength of emitted light and coinciding with the manufacturing process. Since the material of the light-emitting layer 89 is easily affected by exposure to ultraviolet radiation, thermosetting resin may be sometimes better.

An example of the manufacturing method of the organic EL array will be described. First, a TFT 85 is made on the substrate 86. There are known various methods of making the TFT 85. For example, silicon oxide is first deposited into a layer on the glass substrate 86 and amorphous silicon is then deposited into a layer thereon. Excimer laser beam is exposed to the amorphous silicon layer to crystallize to form a polysilicon layer as a channel. After patterning the polysilicon layer, a gate insulating layer is deposited and further a gate electrode is formed of tantalum nitride. Subsequently, source/drain regions for N-channel TFT are formed by ion implantation of phosphorous and source/drain regions for P-channel TFT are formed by ion implantation of boron. After impurities of ion implantation is activated, a first interlayer insulation film is deposited, first contact holes are-formed, source lines are formed, a second interlayer insulation film is deposited, second contact holes are formed and metallic pixel electrodes are formed, thereby completing the array of TFT 85 (for example, see "Polymer Organic EL Display" presented at the 8$^{th}$ Electronic Display Forum (Apr. 18, 2001)). The metallic pixel electrode is a metal membrane electrode of a metal such as Mg, Ag, Al, and Li and functions as an anode 87 for the organic EL element 84 and also as a reflection layer for the organic EL element 84.

An ink composition as a material of hole injection layer is discharged from a head of an inkjet printing device, thereby achieving the patterning application on the anode 87 of the pixel. After the application, the solvent is removed and the applied ink composition is treated by heat, thereby forming the hole injection layer 88.

After forming the hole injection layer 88 on the anode 87, an ink composition as a material of light-emitting layer is discharged from the head of the inkjet printing device, thereby achieving the patterning application on the hole injection layer 88 of the pixel. After the application, the solvent is removed and the applied ink composition is treated by heat, thereby forming the light-emitting layer 89.

The hole injection layer 88 and the light-emitting layer 89 may be formed upside down. It is preferable to form a layer having resistance against moisture on a surface side (a side apart from the substrate 86).

The hole injection layer 88 and the light-emitting layer 89 may be formed by other known method such as a spin coating method, a dipping method, and a vapor deposition method instead of applying the ink composition by the inkjet method as the above. In case high-molecular organic EL material, the inkjet method is suitable. In case of low-molecular organic EL material, the vapor deposition method is suitable.

The material of the light-emitting layer 89 and the material of the hole injection layer 88 may be known materials listed in Japanese Patent Unexamined Publication H10-12377, in which polymer organic EL materials are listed, and Japanese Patent Unexamined Publication H11-138899, in which low-molecular organic EL materials are listed, so description about details will be omitted.

After the hole injection layer 88 and the light-emitting layer 89 are individually formed on the anode 87 of each pixel, the entire surface of the substrate 86 is coated with a transparent electrode by vacuum vapor deposition. The transparent electrode functions as a cathode 90 of the organic EL element 84. The material of the transparent electrode may be selected from a group including a tin oxide film, an indium tin oxide (ITO) film, a combined oxide film of an indium oxide and zinc oxide. Instead of the vacuum vapor deposition, other techniques including the photolithography, the spattering method, and the pyrosol method may be employed.

An array of microlenses in which-microlenses 93 surrounded by the barrier plates 92 are aligned to correspond to the organic EL elements 84 in a one-on-one relation is optically or mechanically joined onto the thus prepared organic EL array with the adhesive layer 91.

Since the emission of light is conducted on the cathode 90 side, i.e. on the other side of the substrate 86 according to the structure shown in FIG. 14, the substrate 86 may be opaque and the circuit for driving is not always the TFT 85. A driving circuit formed by a common silicon process may be employed. In this case, the organic EL element 84 is laminated on the driving circuit.

Now, the barrier plate 92 will be described. As a voltage is applied between the cathode 90 and the anode 87 according to the control of the TFT 85, the light-emitting layer 89 emits light. Though the fluxes of emitted light are emitted from the light-emitting layer 89 isotropically in various directions, light is transmitted through the cathode 90 and is radiated mainly upwardly as seen in FIG. 14 when the anode 87 does not have light transmittancy. Components of light having a small angle relative to the normal line of the light-emitting layer 89 reach the microlens 93, are directly emitted through the microlens 93, and are condensed onto predetermined positions. On the other hand, components of light having a large angle relative to the normal line of the light-emitting layer 89 are directed toward the barrier plate 92 surrounding the microlens 93. When the barrier plate 92 is a metal plate having a number of holes 94 for holding the microlenses. 93 in arrays, the surface of each hole 94 of the barrier plate 92 has light reflectivity. The components are refracted once or several times at the surface of the hole 94 of the barrier plate 92, after that, reach the microlens 93 and are emitted. At least parts of such components are condensed near the position of light condensed directly by the microlens 93 described above. Therefore, in this case, components having a large angle relative to the normal line of the light-emitting layer 89 are also utilized as components of light to be condensed into the arrays, thereby obtaining an exposure head achieving high efficiency with low power and having long life (this is the most important issue in organic EL).

When the barrier plate 92 is made of a material having light absorptivity such as black resite or resin including dispersed carbon powder, components of light having a large angle relative to the normal line of the light-emitting layer 89 are absorbed by the surface of each hole 94, thereby ensuring the elimination of such components having a large angle.

Either the case of the barrier plate 92 having light reflectivity and the case of the barrier plate 92 having light absorptivity can exhibit effect of significantly reducing the incidence of crosstalk in which light beams emitted from the adjacent pixels are superposed on the photoreceptor.

In the structure of emitting light from the cathode 90 side of the organic EL element 84 as shown in FIG. 14, the organic EL element 84 is separated from the outside only by a sealing member (microlens 93) so that the thickness of the organic EL element 84 can be reduced, thereby increasing the amount of light taken from the organic EL element 84. In addition, the distance between the light-emitting part of the organic EL element 84 and the microlens 93 or the barrier plate 92 can be reduced, thereby facilitating the prevention of crosstalk between pixels.

The barrier plate 92 may be a metal having a number of holes 94 aligned in arrays or a resin plate having a number of holes 94 formed by molding to be aligned in arrays. In either case, the material of the barrier plate 92 preferably has the same coefficient of linear expansion as that of the substrate 86. By doing this, even when the temperature is changed, the emitting point of the organic EL element 84 and the microlens 93 in the barrier plate 92 never shift from each other, thereby increasing the temperature stability of the condensing arrays of the exposure head 81. The case that the barrier plate 92 is made of a resin by molding has advantage of achieving the easy and low-cost manufacturing and the reduction in weight.

Though the organic EL array and the microlens array comprising the barrier plate 92 with aligned lenses are prepared separately from each other and joined by the adhesive layer 91 in the aforementioned embodiment, the barrier plate 92 may be formed integrally with the substrate 86. For example, a substrate 86 is formed with holes 94, having constant depth, aligned in arrays in which pixels 83 are arranged, respectively. The function as the barrier plate 92 is imparted to the portion of the substrate 86 besides the holes thereof. On the bottom of each hole, a TFT 85 and an organic element 84 (an anode 87, a hole injection layer 88, a light-emitting layer 89, a cathode 90) are formed and laminated. On the organic element 84, a microlens 93 is disposed. In this case, the substrate 86 itself may have light reflectivity or light absorptivity. Alternatively, in case of the substrate 86 made of a transparent material such as glass, light reflectivity or light absorptivity is imparted to the inner surface of each hole 94 by, for example, applying a light reflective film or a light absorbing film. The case that the barrier plate 92 and the substrate 86 are integrally formed has an advantage of improving the accuracy of position between the light-emitting part of the organic EL element 84 and the microlens 93 and the barrier plate 92.

Figure 15:
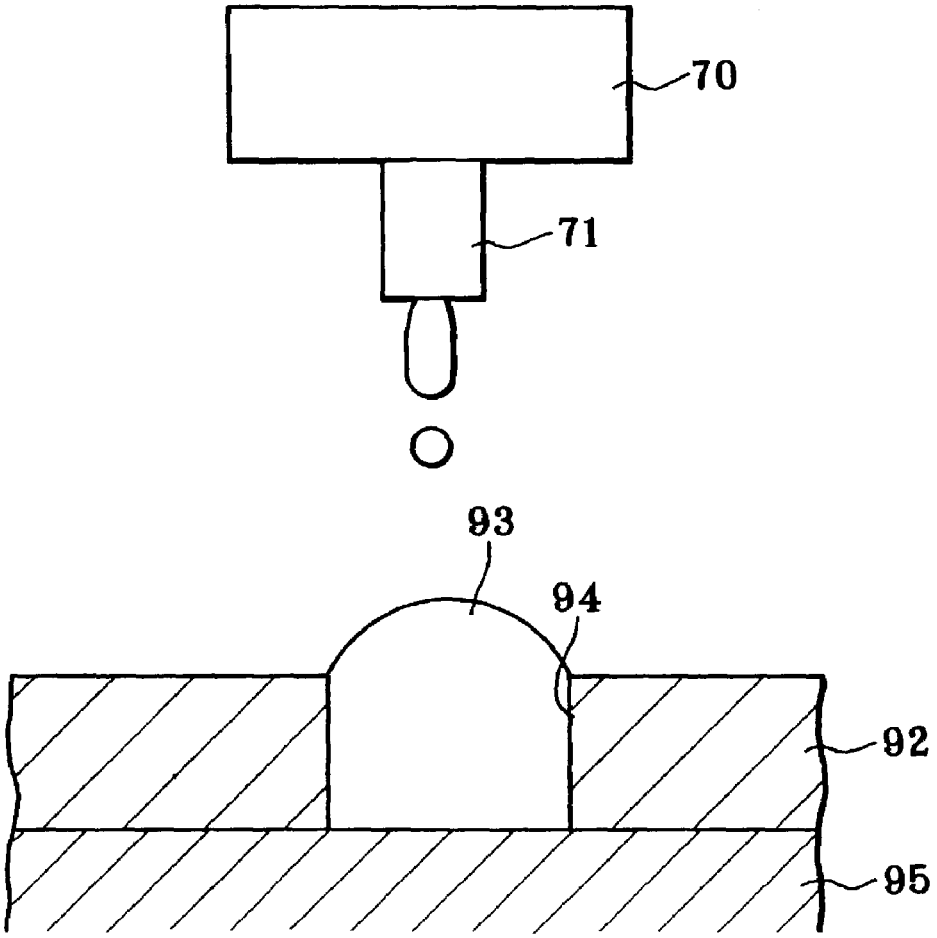
FIG. 15 is an illustration showing the aspect of formation of a microlens which is formed in a hole formed in a barrier plate by the inkjet method.

There are various possible microlenses as the microlens 93 arranged in the barrier plate 92. As shown in FIG. 15, a transparent ink composition as a material of the microlens, for example a UV cure resin monomer, is discharged into the hole 94 formed in the barrier plate 92 from a head 71 of an inkjet printing device 70, thereby achieving the patterning application. After the application, the applied ink composition is cured to swell from the upper surface of the hole 94, thereby forming a convex microlens. The curvature radius of the convex surface of the microlens 93, i.e. the focal length, is determined by the discharging amount of ink composition, the diameter of the hole 94, the surface tension of the transparent ink composition as a material of the microlens, the degree of water repellent relative to the inner surface of the hole 94, the shrinkage rate of the ink composition during curing, and the like. This method has advantages that the formation of lenses having high-precision surface is achieved and that microlenses are easily manufactured without a mold. It should be noted that a member 95 disposed behind the bottom of the hole 94 in FIG. 15 is a backing member which is removed after the ink composition is cured. In case that the barrier plate 92 and the substrate 86 are integrally formed, the member 95 corresponds to the substrate 86, or the TFT 95 or the organic EL element 84 formed thereon.

Alternatively, the microlens 93 formed in the hole 94 of the barrier plate 92 may be made of glass or a transparent resin by replica method. This method achieves high stability of shape of microlens 93 and, in addition, high degree of freedom of shape can be obtained.

Figure 16A:
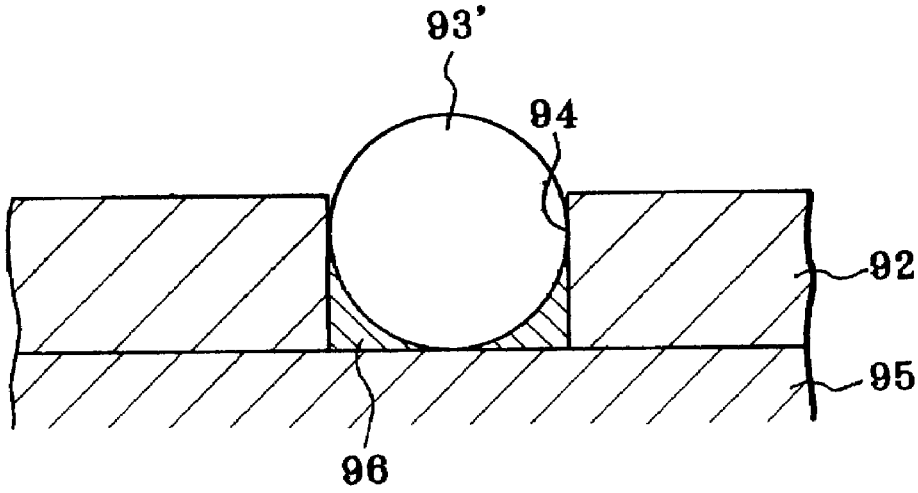
FIGS. 16(*a*), 16(*b*) are illustrations for explaining the formation of a microlens which is formed by fitting a ball lens or semispherical lens into a hole formed in a barrier plate.
Figure 16B:
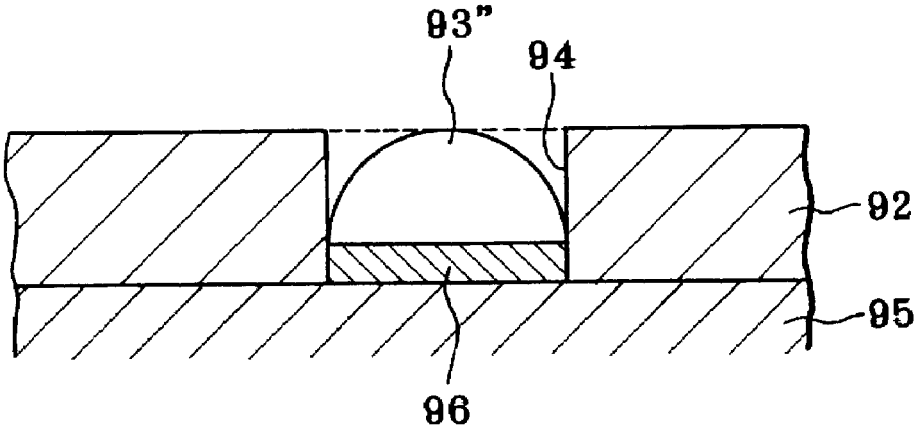

Moreover, glass or resin ball (sphere) lens 93' as shown in FIG. 16(*a*) or semispherical lens 93" as shown in FIG. 16(*b*) may be employed as the microlens 93. In this case, the lens may be fitted into the hole 94 of the barrier plate 92 and fixed by adhesive 96.

The relation between the height of the lens surface of the microlens 93 fitted in the hole 94 of the barrier plate 92 and the height of the upper surface of the barrier plate 92 will be explained. There is a case that the lens surface of the microlens 93 is higher than the upper surface of the barrier plate 92 as shown in FIGS. 14, 15, 16(*a*) and a case that the upper surface of the barrier plate 92 is higher than the lens surface of the microlens 93 as shown in FIG. 16(*b*). In the later case, the barrier plate 92 can function as a protective member to protect the microlens 93 from abrasion and breakage. In the former case, the microlens 93 can be easily manufactured by the inkjet method as shown in FIG. 15.

Figure 17:
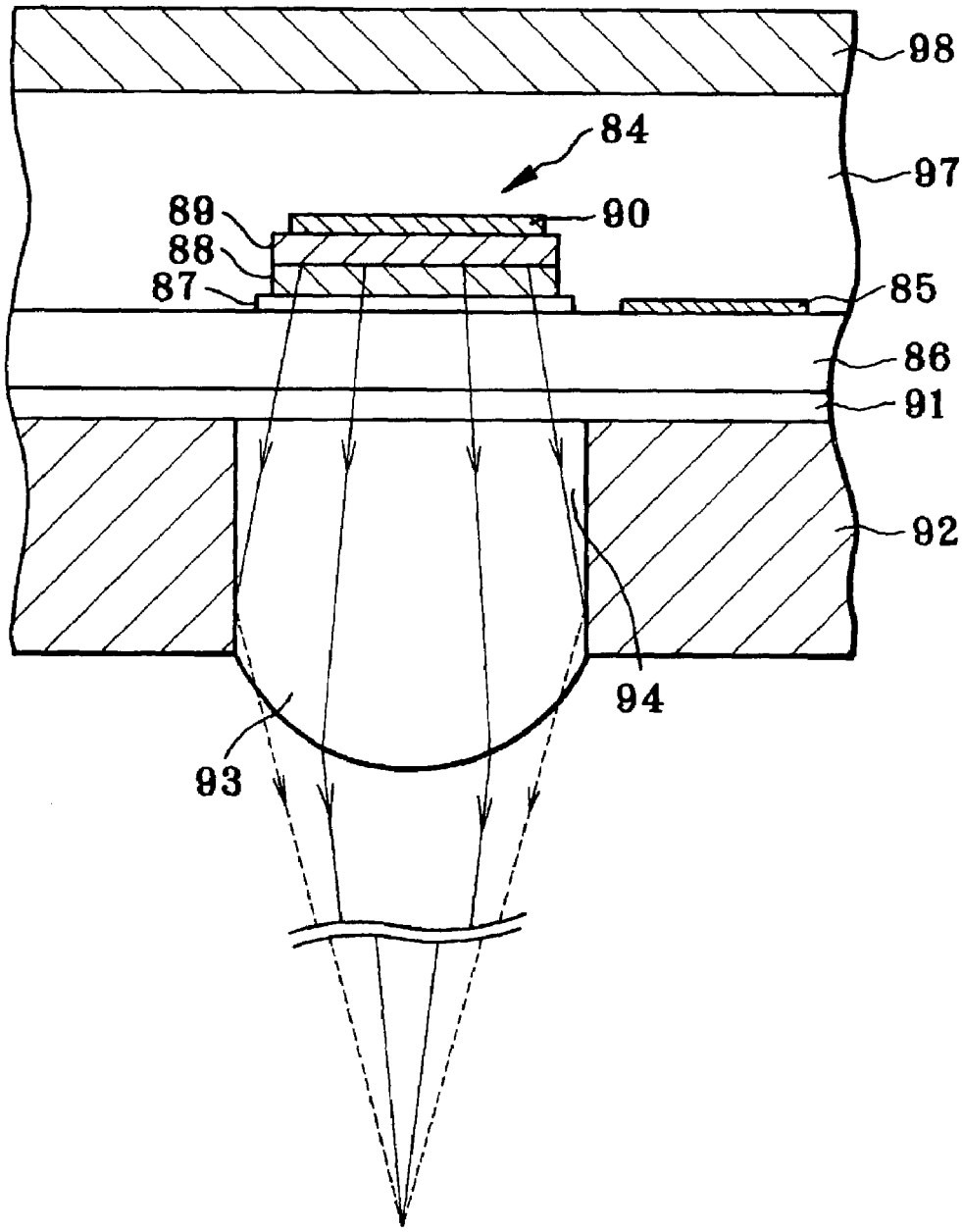
FIG. 17 is a sectional view showing one pixel of an organic EL element which is an example of a type emitting light from the anode side thereof.

Now, an embodiment of the organic EL element 84 of a type in which light is emitted from the anode side will be described with reference to FIG. 17. FIG. 17 is a sectional view showing one pixel of the array taken along a straight line A–A' of FIG. 13.

An organic EL array exposure head 81 comprises organic EL elements 84 formed on a transparent substrate 86 made of glass or the like in the same manner as the case shown in FIG. 14. Each element 84 comprises an anode 87 made of a substantially transparent material such as ITO, a hole injection layer 88, a light-emitting layer 89, a cathode 90 being an electrode made of ITO, an alloy of magnesium and silver, or aluminum, and a sealing member 98 for preventing the deterioration of the light emitting layer 89 due to moisture. The sealing member 98 is fixed onto the cathode 90 by an adhesive layer 97. In this manner, the organic EL array is prepared. The manufacturing method of the organic EL element 84 may be any known method. The respective layers 87, 88, 89, 90 are formed on the substrate 86 by vacuum vapor deposition, cast-coating, or the like. Alternatively, these may be formed by the inkjet method as disclosed in Japanese Patent Unexamined Publication No. H10-12377.

According to the structure of the organic EL array manufactured in this manner, an array composed of the microlenses 93 surrounded by the barrier plate 92 is optically or mechanically joined to the organic EL array via an adhesive layer 91 such that the microlenses 93 are aligned to the organic EL elements 84 in a one-on-one relation, similarly to the case of FIG. 14.

Since the emission of light is conducted on the anode 87 side, i.e. on the substrate 86 side according to the structure shown in FIG. 17, the substrate 86 must be transparent so that a TFT 85 must be used as the driving circuit.

Also in the structure of this embodiment, as a voltage is applied between the cathode 90 and the anode 87 according to the control of the TFT 85, the light-emitting layer 89 emits light. Though the fluxes of emitted light are emitted from the light-emitting layer 89 isotropically in various directions, light is transmitted through the anode 87 and the substrate 86 and is radiated mainly downwardly as seen in FIG. 17 when the cathode 90 does not have light transmittancy. Components of light having a small angle relative to the normal line of the light-emitting layer 89 reach the microlens 93, are directly emitted through the microlens 93, and are condensed onto a predetermined position. On the other hand, components of light having a large angle relative to the normal line of the light-emitting layer 89 are directed toward the barrier plate 92 surrounding the microlens 93. When the hole 94 of the barrier plate 92 has light reflectivity, the components are refracted once or several times at the surface of the hole 94, after that, reach the microlens 93 and are emitted. At least parts of such components are condensed near the position of light condensed directly by the microlens described above. Therefore, in this case, components having a large angle relative to the normal line of the light-emitting layer 89 are also utilized as components of light to be condensed into the arrays, thereby obtaining an exposure head achieving high efficiency with low power and having long life (this is the most important issue in organic EL). When the barrier plate 92 has light absorptivity, components of light having a large angle relative to the normal line of the light-emitting layer 89 are absorbed by the barrier plate 92, thereby ensuring the elimination of such components having a large angle. Therefore, either case can exhibit effect of significantly reducing the incidence of crosstalk in which light beams emitted from the adjacent pixels are superposed on the photoreceptor.

Since the emission of light is conducted on the anode 87 side of the transparent substrate 86 similarly to the conventional organic EL element, the structure of FIG. 17 has advantages of easy selection of material and easy manufacturing method. However, since light is incident on the microlens 93 and the barrier plate 92 through the transparent substrate 86, the distance between the light-emitting part of the organic EL element 84 and the microlens 93 or the barrier plate 92 tends to be long so that the amount of light to be taken from the organic EL element 84 tends to decrease and the incidence of crosstalk between pixels tends to increase. To reduce such tendency, a substrate 86 of which thickness is enough thin is used as the substrate 86 or the substrate 86 is ground down to have a small thickness after the organic EL array is prepared. Currently, the thickness of a substrate available as the substrate 86 is in the order of 0.3 mm. Further, a technology of grinding down the substrate to have a thickness in the order of 0.1 mm may be available. If the mechanical strength is insufficient for handling during the grinding process or as a product, a portion like a frame being enough thick is left on the substrate 86, thus avoiding such problem.

Also in the structure of FIG. 17 that light is emitted from the anode 87 side, the barrier plate 92 and the microlens 93 which are the same as the case of FIG. 14 can be employed. Therefore, the description about the barrier plate 92 and the microlens 93 will be omitted.

Figure 18:
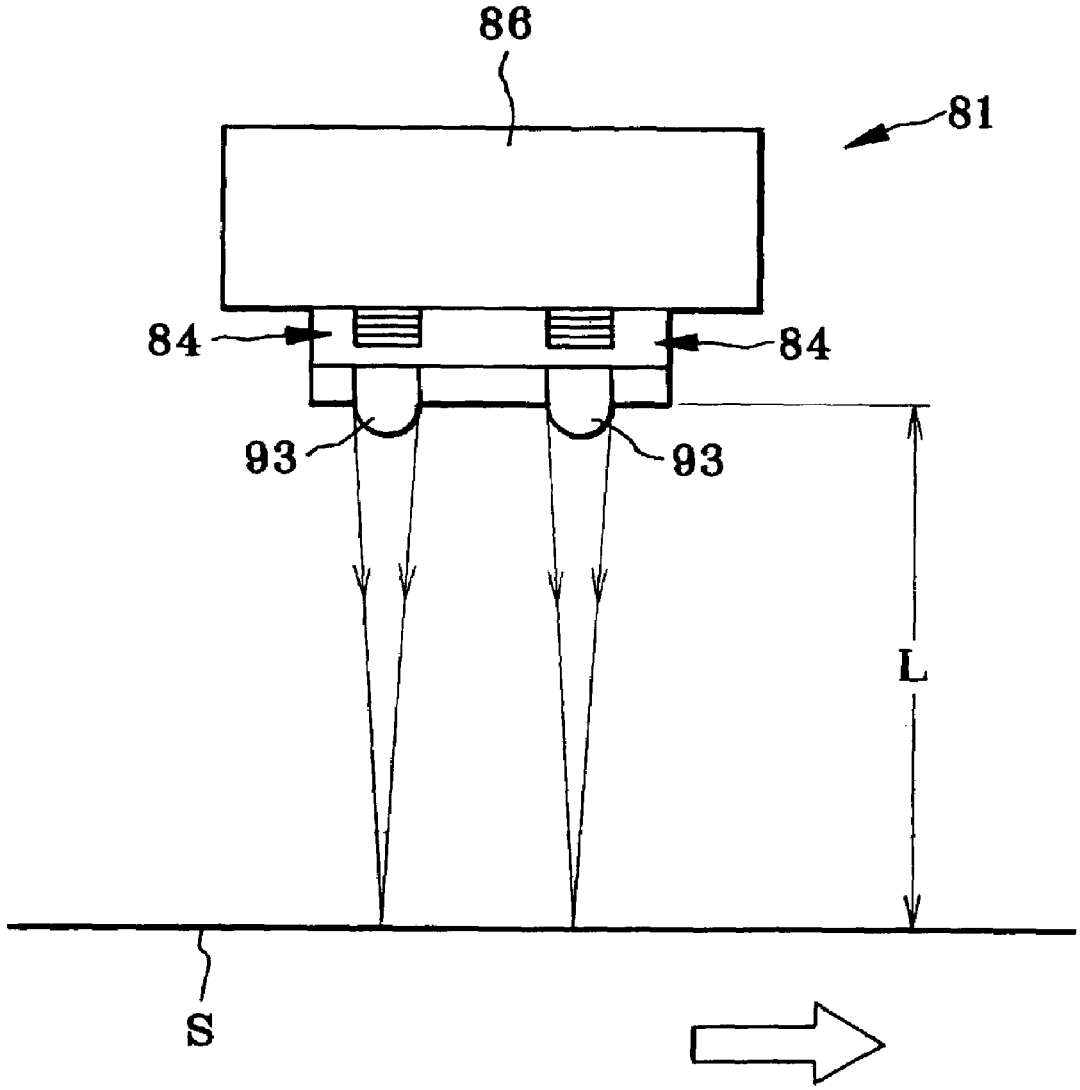
FIG. 18 is a side view showing the aspect of light condensation of the organic EL array exposure head of the embodiment shown in FIGS. 13–17.

The organic EL array exposure head 81 achieving the reduction in incidence of crosstalk by providing the barrier plate surrounding the microlenses according to the present invention as described above condenses fluxes of light emitted from the organic EL light-emitting parts 84 on a surface S a predetermined distance L away from the organic EL array exposure head 81 in the same array pattern as that of the pixels 83 of the organic EL array exposure head 81 as shown in the side view of FIG. 18. Accordingly, a predetermined pattern can be recorded on the surface S by moving the surface S relative to the organic EL array exposure head 81 in a direction perpendicular to the longitudinal direction of the organic EL array exposure head 81 and, at the same time, controlling the light emission from the organic EL light-emitting parts 84 of the organic EL array exposure head 81 through the TFTs 85.

Figure 19:
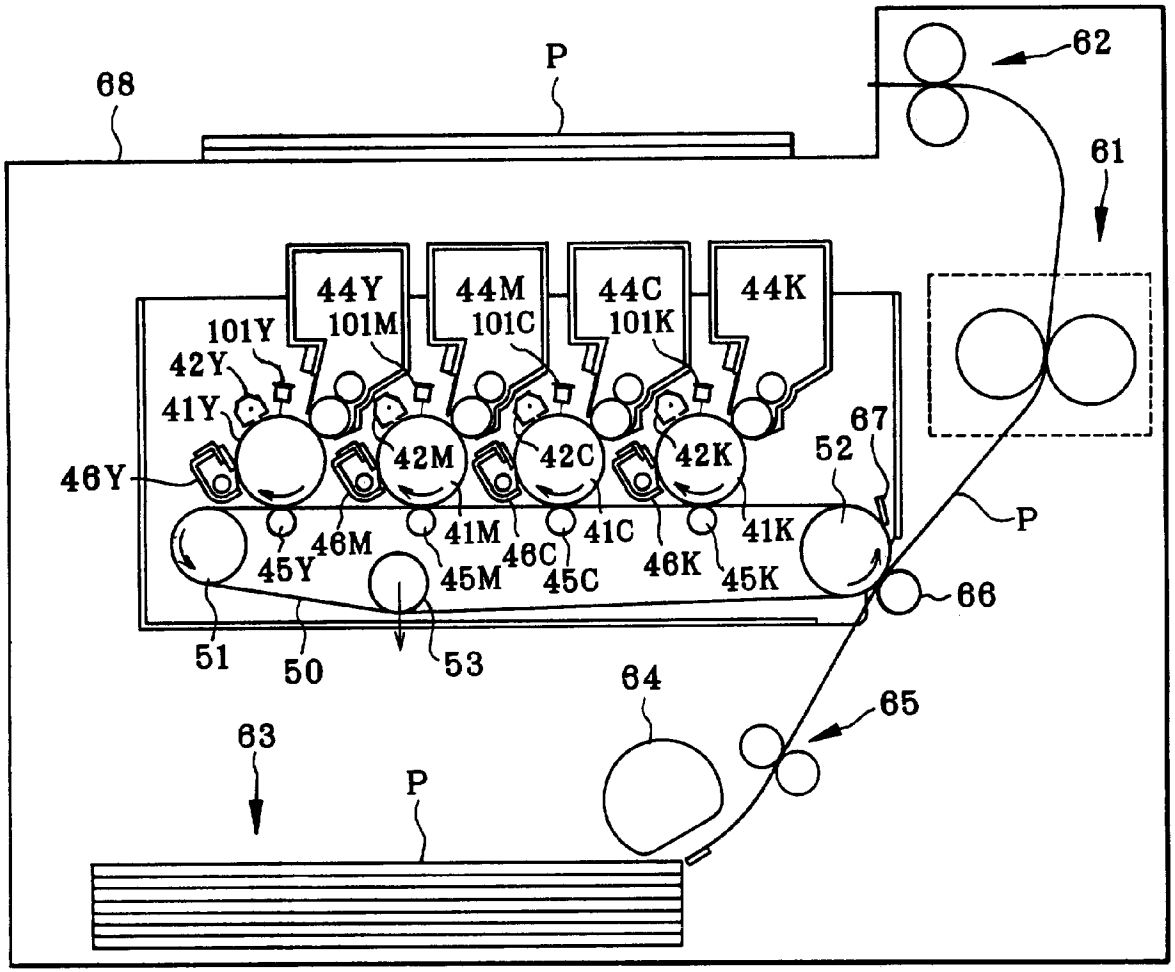
FIG. 19 is a front view schematically showing the entire structure of an example of a full-color image forming apparatus of a tandem type employing the optical writing head or the organic EL array exposure head of the present invention.

In the present invention, the optical writing head or the organic EL array exposure head 101 having the organic EL array of the present invention, as stated above, is used as an exposure head, for example, of a full-color image forming apparatus of electrophotographic type. FIG. 19 is a front view schematically showing the entire structure of an example of a full-color image forming apparatus of a tandem type in which four similar optical writing heads (organic EL array exposure heads) 101K, 101C, 101M and 101Y according to the present invention are disposed at the respective exposure positions of four similar photosensitive drums 41K, 41C, 41M and 41Y corresponding thereto. As shown in FIG. 19, the image forming apparatus has an intermediate transfer belt 50 stretched between a driving roller 51 and a driven roller 52 with tension applied thereto by a tension roller 53 and driven to circulate in the direction of arrows shown in FIG. 19 (counter clockwise direction) by the driving roller 51. Four photoreceptors 41K, 41C, 41M and 41Y are disposed at predetermined distance relative to the intermediate transfer belt 50. Each photoreceptor has a photosensitive layer on the outer peripheral surface thereof to serve as an image carrier. Suffixes "K", "C", "M", and "Y" added to reference numerals indicate black, cyan, magenta, and yellow, respectively. That is, the photoreceptors designated by reference numerals with such suffixes are photoreceptors for black, cyan, magenta, and yellow, respectively. The same is true for other members. The photoreceptors 41K, 41C, 41M and 41Y are driven to rotate in the direction-of arrows shown in FIG. 19 (clockwise direction) synchronously with the driving of the intermediate transfer belt 50. Arranged around each photoreceptor 41 (K, C, M, Y) are a charging means (corona charger) 42 (K, C, M, Y) for uniformly charging the outer peripheral surface of the photoreceptor 41 (K, C, M, Y), an optical writing head or an organic EL array exposure head 101 (K, C, M, Y) having the aforementioned structure of the present invention for sequentially line-scanning the outer peripheral surface of the photoreceptor 41 (K, C, M, Y), which has been uniformly charged by the charging means 42 (K, C, M, Y), synchronously with the rotation of the photoreceptor 41 (K, C, M, Y), a developing device 44 (K, C, M, Y) for applying toner as a developer to an electrostatic latent image formed by the optical writing head 101 (K, C, M, Y) to form a visible image (toner image), a primary transfer roller 45 (K, C, M, Y) serving as transfer means for sequentially transferring the toner image developed by the developing device 44 (K, C, M, Y) onto the intermediate transfer belt 50 as a primary transfer target, and a cleaning device 46 (K, C, M, Y) as cleaning means for removing the toner remaining on the surface of the photoreceptor 41 (K, C, M, Y) after the transfer of the toner image.

Each optical writing head 101 (K, C, M, Y), as shown in FIG. 6, has ball lenses 10 aligned to correspond to the organic EL light-emitting parts 22 in a one-on-one relation or microlenses 93 with a predetermined focal length formed, by the inkjet method in the holes 94 of the barrier plate 92 formed at positions corresponding to the light-emitting parts of the organic EL elements 84. The optical writing head 101 (K, C, M, Y) is installed a work distance WD (L) away from the surface of the corresponding photoreceptor 41 (K, C, M, Y) in such a manner that the array direction of the optical writing head 1 (K, C, M, and Y) is parallel to the bus-bar of the photoreceptor 41 (K, C, M, Y). The emission energy peak wavelength of each optical writing head 101 (K, C, M, Y) and the sensitivity peak wavelength of the photoreceptor 41 (K, C, M, Y) are set to be approximately coincident with each other.

The developing device 44 (K, C, M, Y) uses a non-magnetic single-component toner as a developer, for example. The single-component developer is conveyed to a development roller through a supply roller, for example, and the thickness of the developer layer adhering to the development roller surface is regulated with a regulating blade. The development roller is brought into contact with or pressed against the photoreceptor 41 (K, C, M, Y) to allow the developer to adhere to the surface of the photoreceptor 41 (K, C, M, Y) according to the electric potential level thereof, thereby developing the electrostatic latent image into a toner image.

Toner images of black, cyan, magenta and yellow formed by unicolor toner image forming stations for the four colors are sequentially primarily transferred onto the intermediate transfer belt 50 by a primary transfer bias voltage applied to the respective primary transfer rollers 45 (K, C, M, and Y), and sequentially superimposed on each other on the intermediate transfer belt 50 to form a full-color toner image, which is then secondarily transferred onto a recording medium "P" at a secondary transfer roller 66. The transferred full-color toner image is fixed on the recording medium "P" by passing between a pair of fixing rollers 61 as a fixing device. Then, the recording medium "P" is discharged through a pair of sheet delivery rollers 62 onto an outfeed tray 68 formed on the top of the apparatus body.

In FIG. 19, reference numeral 63 designates a sheet cassette in which a stack of a large number of recording media "P" is held, 64 designates a pickup roller for feeding the recording medium "P" from the sheet cassette 63 one by one, 65 designates a pair of gate rollers for regulating the timing at which each recording medium "P" is supplied to the secondary transfer portion at a secondary transfer roller 66, 66 designates the secondary transfer roller as a secondary transfer means for forming the secondary transfer portion together with the intermediate transfer belt 50, 67 designates a cleaning blade as cleaning means for removing the toner remaining on the surface of the intermediate transfer belt 50 after the secondary transfer.

When the organic EL array exposure head 81 is used as an exposure head of such an image forming apparatus of electrophotographic type, toner as developer may adhere to the lens surface of the microlens 93 and thus blur the lens surface, leading to creation of image defects due to exposure irregularity or the like. For this, materials are preferably selected to satisfy both the following relations among the work function $\Phi_L$ of the material for the microlens 93 of the organic EL array exposure head 81, the work function $\Phi_B$ Of the material of the barrier plate 92, and the work function $\Phi_T$ of the material of the toner:

$$|\Phi_T - \Phi_L| \leq 0.2 \text{ eV} \quad (1)$$

$$|\Phi_T - \Phi_B| \geq 0.5 \text{ eV} \quad (2)$$

By employing such a combination of materials as to satisfy the above conditions, the toner blurring the organic EL array exposure head 81 adheres only to the barrier plate 92 surrounding the microlenses 93 not to the lens surfaces, thereby preventing the lens surfaces of the microlenses 93 from being burred with the toner.

Though the optical writing head such as the organic EL array exposure head, the method of manufacturing the same, and the image forming apparatus employing the same according to the present invention have been described above by way of embodiments, it should be noted that the present invention is not limited to the foregoing embodiments so that various changes may be made. For example, in a manufacturing process, ball lenses are aligned in two-dimensional array on a sheet substrate with organic EL array in two-dimensional array having large rectangular shape and fixed. After that, the substrate is cut into linear pieces. During this, by forming hole pattern (FIG. 3) in two-dimensional configuration, the ball lenses can be positioned entirely at once. Alternatively, by applying adhesive at positions corresponding to the light-emitting parts by the inkjet method or the like without such a hole pattern, the ball lenses can be positioned and fixed by the adhesive.

As clear from the foregoing description, according to the optical writing head of the present invention achieving the first object, ball lenses are aligned to correspond to light-emitting parts of a light-emitting element array or shatter parts of optical shutter element array, respectively, thereby preventing the occurrence of periodical optical irregularity which has been conventionally occurred due to use of condensing rod lenses. In addition, the reduction in size of the optical writing head can be achieved and enough work distance can be ensured.

Further, according to the optical writing head of the present invention achieving the second object, a barrier plate, having optical holes for preventing crosstalk of light i.e. a phenomenon that fluxes of light emitted from the light-emitting parts of adjacent organic EL elements are immixed at the condensing position of light from the light-emitting part of either organic EL element, is provided on the light-emitting side of the array of organic EL elements, thereby reducing the incidence of crosstalk and thereby obtaining enough resolution and contrast.

The invention claim is:

1. An image forming apparatus comprising:

an organic EL array exposure head for writing an image on an image carrier, said organic EL array exposure head comprising:

a long transparent substrate, an array of organic EL elements aligned just like pixels aligned in at least one row, and a barrier plate formed with optical holes for preventing crosstalk of light, where crosstalk of light is a phenomenon that fluxes of light emitted from the light-emitting parts of adjacent organic EL elements are immixed at the condensing position of light from the light-emitting part of either organic EL element, wherein said barrier plate is arranged on the output side of said array of the organic EL elements on a side of said transparent substrate that is opposite to a side where said array of the organic EL elements is arranged, plus lenses are arranged at positions of said holes of said barrier plate, respectively, said image forming apparatus is a color image forming apparatus of a tandem type having at least two image forming stations each comprising a charging means, an exposure head, a developing means with toner, and a transfer means which are arranged around an image carrier, wherein said color image forming apparatus forms a color image by passing a transfer medium through the respective stations, and said image forming apparatus satisfies both the following relations:

$$|\Phi_T - \Phi_L| \leq 0.2 \text{ eV} \quad (1)$$

$$|\Phi_T - \Phi_B| \geq 0.5 \text{ eV} \quad (2)$$

wherein $\phi_L$ is the work function of the material for said plus lenses, $\phi_B$ is the work function of the material of said barrier plate, and $\phi_T$ is the work function of the material of toner.

* * * * *